US009321292B2

(12) United States Patent
Morita

(10) Patent No.: US 9,321,292 B2
(45) Date of Patent: Apr. 26, 2016

(54) AFTER-PROCESSING DEVICE AND IMAGE FORMATION APPARATUS

(71) Applicant: Konica Minolta, Inc., Chiyoda-ku (JP)

(72) Inventor: Ryo Morita, Toyohashi (JP)

(73) Assignee: KONICA MINOLTA, INC., Chiyoda-Ku, Tokyo (JP)

( * ) Notice: Subject to any disclaimer, the term of this patent is extended or adjusted under 35 U.S.C. 154(b) by 0 days.

(21) Appl. No.: 14/226,115

(22) Filed: Mar. 26, 2014

(65) Prior Publication Data

US 2014/0291911 A1 Oct. 2, 2014

(30) Foreign Application Priority Data

Apr. 1, 2013 (JP) ..... 2013-076207

(51) Int. Cl.

| | |
|---|---|
| ***B42C 1/12*** | (2006.01) |
| *B65H 45/04* | (2006.01) |
| *B65H 45/20* | (2006.01) |
| *B65H 45/18* | (2006.01) |

(52) U.S. Cl.

CPC . *B42C 1/12* (2013.01); *B65H 45/04* (2013.01); *B65H 45/18* (2013.01); *B65H 45/20* (2013.01)

(58) Field of Classification Search

CPC ..... B42C 1/12; B65H 2301/42268; B65H 37/06; B65H 45/18; B65H 45/20; B65H 45/04; G03G 2215/00877

See application file for complete search history.

(56) References Cited

U.S. PATENT DOCUMENTS

| | | | | |
|---|---|---|---|---|
| 6,394,441 | B1 * | 5/2002 | Cruz et al. | 270/37 |
| 8,844,919 | B2 * | 9/2014 | Motoyoshi | 270/37 |
| 2002/0063373 | A1 * | 5/2002 | Sanders | 270/58.08 |
| 2007/0114710 | A1 * | 5/2007 | Stauber | 270/52.16 |

FOREIGN PATENT DOCUMENTS

| | | | |
|---|---|---|---|
| JP | 2006-062803 | A | 3/2006 |
| JP | 2007-084324 | A | 4/2007 |
| JP | 2008-230814 | A | 10/2008 |
| JP | 2013-52939 | A | 3/2013 |

OTHER PUBLICATIONS

JPO Machine Translation of Morita et al., JP 2013052939 A, published Mar. 21, 2013.*

(Continued)

*Primary Examiner* — Jennifer Simmons

(74) *Attorney, Agent, or Firm* — Buchanan Ingersoll & Rooney PC

(57) ABSTRACT

An after-processing device for performing sheet folding includes a pair of folding rollers, a heating member, and a supporting unit. The pair of folding rollers is configured to fold a sheet. The heating member is located downstream of the pair of folding rollers in terms of a sheet conveyance direction. The supporting unit supports the heating member in a manner such that position of the heating member in terms of the sheet conveyance direction is changeable in accordance with an amount of conveyance imparted on the sheet by the pair of folding rollers after folding. The position of the heating member in terms of the sheet conveyance direction changes such that the heating member is in contact with a leading edge of a fold portion of the sheet.

14 Claims, 21 Drawing Sheets

(56) References Cited

OTHER PUBLICATIONS

Office Action (Notification of Reasons for Refusal) issued on Mar. 17, 2015, by the Japanese Patent Office in corresponding Chinese Patent Application No. 2013-076207, and an English Translation of the Office Action. (4 pages).

Office Action (Notification of Reasons for Refusal) issued on Mar. 17, 2015, by the Japanese Patent Office in corresponding Japanese Patent Application No. 2013-076207, and an English Translation of the Office Action. (4 pages).

* cited by examiner

Double folding

Triple folding

<Standby position>

<Heating position>

Time t1

Time t2

Time t3

Time t4

Triple folding

AFTER-PROCESSING DEVICE AND IMAGE FORMATION APPARATUS

This application is based on application No. 2013-76207 filed in Japan, the contents of which are hereby incorporated by reference.

BACKGROUND OF THE INVENTION (1) Field of the Invention

The present invention relates to an after-processing device for sheet folding and an image formation apparatus including the after-processing device.

(2) Description of the Related Art

When an image formation apparatus such as a printer executes a job, a plurality of printed sheets are stacked one on top of another forming a sheet bundle. An after-processing device has been developed in order to process the sheet bundle into a booklet shape such as a magazine. The after-processing device has a sheet-folding function of folding the sheet bundle by inserting a folding target position of the sheet bundle into a nip between a pair of folding rollers.

If the sheet bundle is simply folded, bulging occurs after folding due to the sheet bundle gradually opening-up over time. Consequently, the sheet bundle has an unattractive appearance.

In consideration of the above, Japanese Patent Application Publication No. 2006-62803 discloses a configuration for restricting opening-up of a sheet bundle by holding a sheet surface region of the sheet bundle extending for 2 cm from a fold thereof between a pair of heating members for several seconds, while applying pressure and heat.

In a configuration such as disclosed in the aforementioned publication, in which the sheet bundle is held between the pair of heating members and the sheet surface region extending for 2 cm from the fold is designated as a heating region, the heating members are required to be large in order to match size of the heating region which is also large. As a consequence of the above, the heating members have a large heat capacity, increasing electrical power consumption which is required for heating.

Furthermore, when the sheet bundle has a large thickness it becomes difficult to apply the heating members against the fold, at which requirement of heating is greatest. As a consequence of the above, heat applied to the surface of the sheet bundle by the heating members is not easily conducted to the fold, increasing an amount of time required to heat the sheet bundle, and reducing thermal efficiency.

In order that heat is directly applied to a fold portion of a sheet bundle, a configuration is considered in which, for example, a heating member is located at a position downstream of a pair of folding rollers in terms of a sheet conveyance direction, and the sheet bundle is conveyed after folding such that a leading edge of the fold portion of the sheet bundle comes into contact with the heating member.

Unfortunately, each sheet bundle may differ, for example in terms of sheet number, sheet thickness, and sheet type (for example, a sheet type which is difficult to fold). Consequently, there is variation in amount of rotational load that is applied to the pair of folding rollers during folding of a sheet bundle, making it likely that variation also occurs in terms of amount of conveyance imparted on the sheet bundle by the pair of folding rollers after folding.

For example, if the amount of conveyance imparted on the sheet bundle is excessively small, it may not be possible to heat the leading edge of the fold portion of the sheet bundle due to the leading edge not reaching the heating member.

On the other hand, if the amount of conveyance imparted on the sheet bundle is excessively large, a portion of the sheet bundle between the leading edge of the fold portion and the pair of folding rollers may become greater in length than a distance between the pair of folding rollers and the heating member, causing bending of the aforementioned portion of the sheet bundle and displacement of the leading edge of the fold portion from the heating member. The situation described above may result in a problem of insufficient heating. A similar problem occurs even when folding single sheets due to differences between the single sheets, for example in terms of sheet thickness or sheet type.

SUMMARY OF THE INVENTION

An objective of the present invention is to provide an after-processing device and an image formation apparatus capable of appropriately heating a leading edge of a fold portion of a sheet.

In order to achieve the objective described above, an after-processing device for sheet folding relating to the present invention comprises: a pair of folding rollers configured to fold a sheet; a heating member located downstream of the pair of folding rollers in terms of a sheet conveyance direction; and a supporting unit that supports the heating member in a manner such that position of the heating member in terms of the sheet conveyance direction is changeable in accordance with an amount of conveyance imparted on the sheet by the pair of folding rollers after folding, wherein the position of the heating member in terms of the sheet conveyance direction changes such that the heating member is in contact with a leading edge of a fold portion of the sheet.

Alternatively, in order to achieve the objective described above, an image formation apparatus relating to the present invention comprises: an image formation device configured to form an image on a sheet; and an after-processing device configured to perform after-processing on the sheet on which the image has been formed, wherein the after-processing device includes: a pair of folding rollers configured to fold the sheet; a heating member located downstream of the pair of folding rollers in terms of a sheet conveyance direction; and a supporting unit that supports the heating member in a manner such that position of the heating member in terms of the sheet conveyance direction is changeable in accordance with an amount of conveyance imparted on the sheet by the pair of folding rollers after folding, and the position of the heating member in terms of the sheet conveyance direction changes such that the heating member is in contact with a leading edge of a fold portion of the sheet.

BRIEF DESCRIPTION OF DRAWINGS

These and the other objects, advantages and features of the invention will become apparent from the following description thereof taken in conjunction with the accompanying drawings which illustrate a specific embodiment of the invention.

In the drawings.

DESCRIPTION OF PREFERRED EMBODIMENTS

The following describes embodiments of an after-processing device and an image formation apparatus relating to the present invention with reference to the drawings.

(1) Overall Configuration

Figure 1:
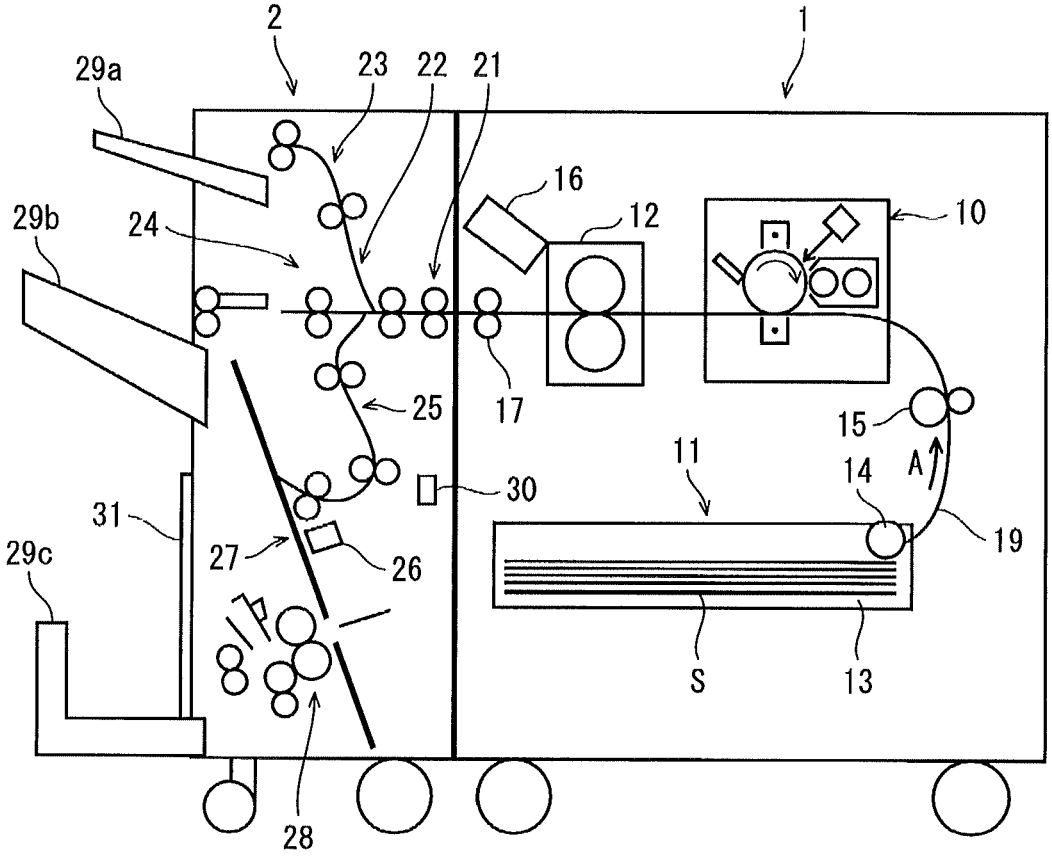
FIG. 1 illustrates configuration of an image formation device and an after-processing device.

FIG. 1 illustrates configuration of an image formation device 1 and an after-processing device 2.

As illustrated in FIG. 1, the image formation device 1 includes an image creation unit 10, a sheet supply unit 11, and a fixing unit 12. The image formation device 1 forms an image on a sheet.

In the sheet supply unit 11, a pick-up roller 14 picks-up a sheet stored in a sheet cassette 13, indicated as sheet S in FIG. 1, and conveys the sheet S along a conveyance path 19. The picked-up sheet S is conveyed by conveyance rollers 15 to the image creation unit 10, in a direction indicated by arrow A.

The image creation unit 10 forms a toner image on a photosensitive drum through an electrographic method, and transfers the toner image onto the sheet S conveyed from the sheet supply unit 11.

The fixing unit 12 applies heat and pressure on the toner image which has been transferred onto the sheet S. After fixing, the sheet S is cooled by a cooling unit 16, configured by a fan or the like. The sheet S is ejected (output) by ejection rollers 17 and conveyed to the after-processing device 2. Note that the image formation device 1 is not limited to using the electrographic method, and alternatively may for example use an inkjet method.

The after-processing device 2 includes a sheet injector 21, a conveyance path switcher 22, sheet conveyers 23, 24 and 25, a stapler 26, a sheet stacker 27, a sheet folder 28, ejection trays 29*a*, 29*b* and 29*c*, and a controller 30. The after-processing device 2 has a function of performing after-processing on the sheet S which is output from the image formation device 1. The after-processing for example includes a stapling function of performing binding using a staple, and a sheet folding function of performing double folding or triple folding.

(2) Double Folding and Triple Folding

Figure 2A:
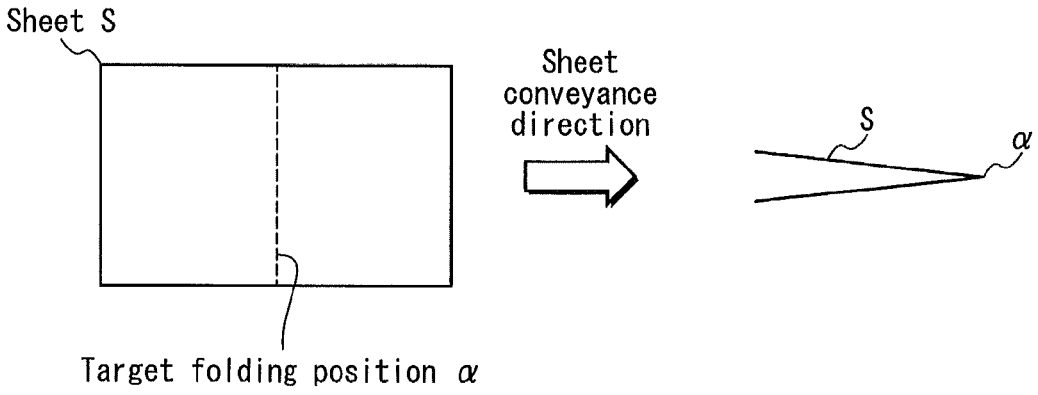
FIG. 2A schematically illustrates appearance of a sheet before and after double folding of the sheet through a sheet-folding function, and FIG. 2B schematically illustrates appearance of a sheet before and after triple folding of the sheet through a sheet-folding function.
Figure 2B:
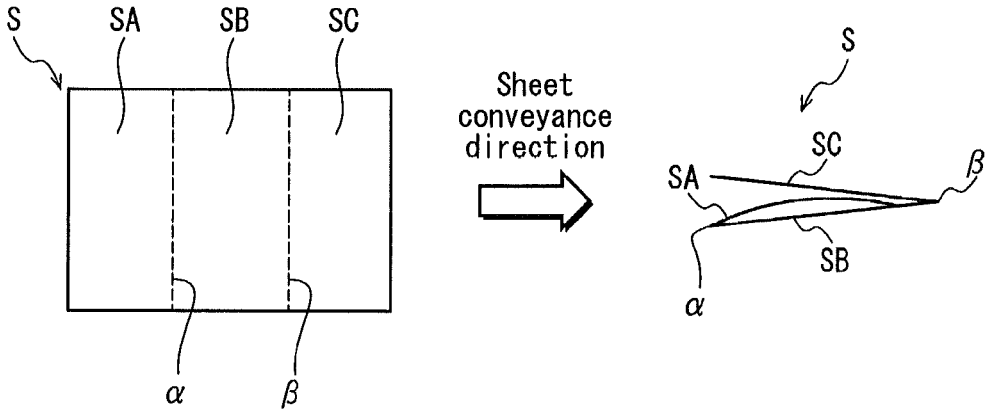

FIGS. 2A and 2B schematically illustrate appearance before and after a sheet is folded through the sheet folding function. FIG. 2A illustrates an example of double folding and FIG. 2B illustrates an example of triple folding.

As illustrated in FIG. 2A, in the case of double folding the sheet S is folded in half using a position midway along the sheet S in terms of a sheet conveyance direction as a target folding position α.

As illustrated in FIG. 2B, in the case of triple folding two positions spaced in terms of the sheet conveyance direction are respectively used as target folding positions α and β. In triple folding the sheet S is first folded at the target folding position α (first fold) and is subsequently folded at the target folding position β (second fold), such that a flap SA is sandwiched between a flap SB and a flap SC. The type of folding described above may be referred to as a letter fold or a C-fold.

Note that the double folding and the triple folding are not limited to a single sheet S. The double folding or the triple folding may alternatively be performed on a sheet bundle consisting of two or more sheets S stacked one on top of another.

(3) Configuration of after-Processing Device 2

Figure 3:
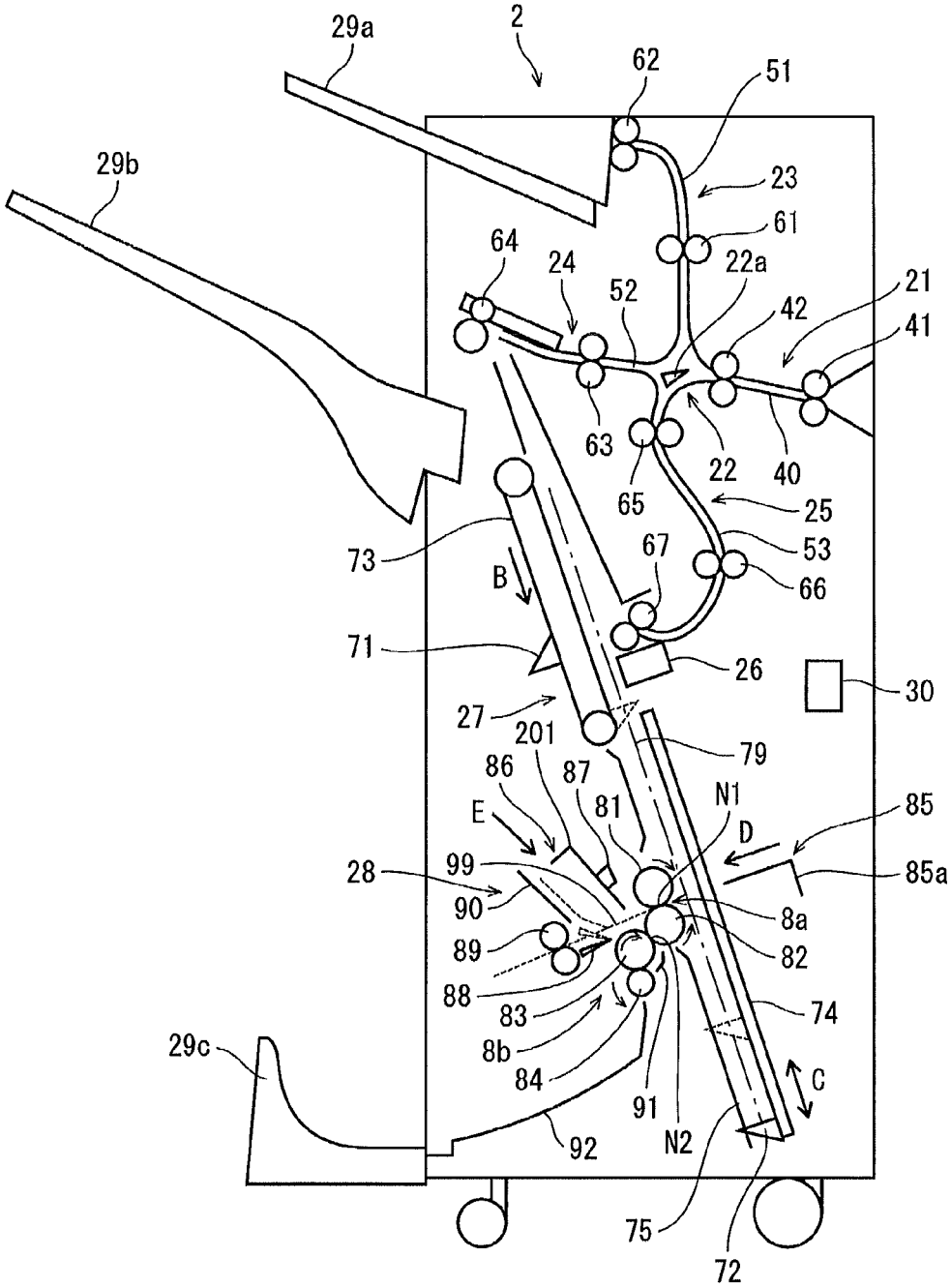
FIG. 3 illustrates detailed configuration of the after-processing device.

FIG. 3 illustrates detailed configuration of the after-processing device 2.

As illustrated in FIG. 3, the sheet injector 21 receives the sheet S output from the image formation device 1. Conveyance rollers 41 and 42 convey the sheet S along a conveyance path 40 to the conveyance path switcher 22.

The conveyance path switcher 22 uses a switching claw 22*a* to switch a conveyance destination for the sheet S, conveyed from the sheet injector 21, between conveyance paths 51, 52 and 53. The conveyance path switcher 22 switches to the conveyance path 51 when the sheet S is to be stored in the ejection tray 29*a* without performing after-processing. The conveyance path switcher 22 switches to the conveyance path 52 when the sheet S is to be stored in the ejection tray 29*b* without performing after-processing. The conveyance path switcher 22 switches to the conveyance path 53 when the stapling function or the sheet folding function is to be performed. The sheet S, conveyed from the sheet injector 21, is conveyed along whichever of the conveyance paths 51-53 is switched to.

When the conveyance path switcher 22 causes the sheet S to be conveyed along the conveyance path 51, the sheet conveyer 23 conveys the sheet S using conveyance rollers 61 and 62, and subsequently stores the sheet S on the ejection tray 29*a*.

When the conveyance path switcher 22 causes the sheet S to be conveyed along the conveyance path 52, the sheet conveyer 24 conveys the sheet S using conveyance rollers 63 and 64, and subsequently stores the sheet S on the ejection tray 29*b*.

When the conveyance path switcher 22 causes the sheet S to be conveyed along the conveyance path 53, the sheet conveyer 25 conveys the sheet S toward the sheet stacker 27 using conveyance rollers 65, 66 and 67.

The sheet stacker 27 has two stoppers 71 and 72, and has a function of temporarily storing the sheet S for after-processing when the sheet S is conveyed thereto by the sheet conveyer 25. In the present embodiment the after-processing is stapling and sheet folding.

The stopper 71 is fixed on a belt 73 which circulates in a direction indicated by arrow B. The stopper 71 moves in accompaniment to circulation of the belt 73. The stopper 72 is supported by a straight bar 74 in a manner such as to be freely moveable in a direction indicated by arrow C.

[Stapling]

When stapling is to be performed on a sheet bundle Sb consisting of a plurality of sheets S, the stopper 71 is held at a position indicated by a broken line in FIG. 3. In the state described above, when one the sheets S is conveyed from the conveyance rollers 67, the sheet S drops along a conveyance path 79, and a bottom edge of the sheet S is halted by the stopper 71 located at the position indicated by the broken line. The sheet S is stored such as to be orientated along the belt 73. The storage operation described above is repeated for each of the sheets S which is conveyed, resulting in the plurality of sheets S being stacked on the belt 73. Note that while the plurality of sheet S are in a stacked state, an adjustment unit (not illustrated) performs adjustment on the sheet bundle, consisting of the sheets S, in terms of a width direction thereof.

When all of the sheets S which are to be stapled are stacked as the sheet bundle, stapling is performed on the sheet bundle by the stapler 26. Once stapling has been performed on the sheet bundle, the sheet bundle is conveyed in an upward direction by circulation of the belt 73 with a bottom edge of the sheet bundle being held by the stopper 71, and is ejected onto the ejection tray 29*b* through the conveyance rollers 64.

[Sheet Folding]

When sheet folding is to be performed, the stopper 71 is held at a position indicated by a solid line in FIG. 3.

The stopper 72 is held at a predetermined position in accordance with sheet size and whether double folding or triple folding is to be performed. For example, the stopper 72 may be held at a position indicated by a broken line or a position indicated by a solid line in FIG. 3.

Through adjustment of holding position of the stopper 72 in accordance with sheet size, even when there is variation in sheet size, each sheet S can be held at a position such that, for example in the case of double folding of the sheet S at a midpoint thereof in terms of sheet conveyance direction, the midpoint of the sheet S is at a corresponding position to a folding knife 85*a*, and the sheet S is folded at the midpoint (i.e., at the target folding position $\alpha$). Furthermore, a target folding position for double folding and a target folding position for triple folding differ, even when the sheet S is the same size in both folding methods. Therefore, altering holding position of the stopper 72 in accordance with folding method enables folding to be performed at the target folding position for the aforementioned folding method.

When a single sheet S drops along the conveyance path 79 while the stopper 72 is held at the predetermined position in accordance with sheet size, a bottom edge of the sheet S is halted by the stopper 72, and the sheet S is stored such as to be orientated along a guide 75. In the case of a sheet bundle consisting of a plurality of sheets S, the storage operation described above is repeated for each of the sheets S, and the sheets S are stacked on the guide 75.

Once all of the sheets S on which sheet folding is to be performed are stacked, the sheet folder 28 performs a sheet folding operation, and subsequently performs a heating operation on a leading edge of a fold portion as described in detail further below.

Note that the stapling function and the sheet folding function may be combined such that a sheet bundle is stapled at a target folding position, and subsequently an operation is performed to fold the sheet bundle at the target folding position. In the situation described above, position of the stopper 72 is adjusted such that the sheet bundle is held at a position at which the target folding position of the sheet bundle corresponds to the stapler 26. After stapling, the stopper 72 is lowered to a predetermined position in accordance with the target folding position, and a folding operation is performed on the sheet bundle.

The following describes configuration of the sheet folder 28, operation of the sheet folder 28 during double folding, and operation of the sheet folder 28 during triple folding, in respective order.

(4) Configuration of Sheet Folder 28

The sheet folder 28 includes the folding rollers 81, 82 and 83, a conveyance roller 84, a first folding knife unit 85, a second folding knife unit 86, a heating member 87, a conveyance path switching claw 88, ejection rollers 89, and guides 90, 91 and 92.

Each of the folding rollers 81-83 includes an elastic layer made of a material such as rubber.

The folding rollers 81 and 82 are a pair of rollers used in double folding and triple folding of the sheet S. The folding rollers 81 and 82 are in contact with one another, forming a nip N1 at a contact position therebetween. The present embodiment adopts a mechanism in which the folding roller 82 is pressed against the folding roller 81 by a compression spring 822 (FIG. 11) that acts as a biasing member.

The folding roller 83 is only used as a pair of rollers with the folding roller 82 during triple folding. The folding roller 83 is in contact with the folding roller 82, forming a nip N2 at a contact position therebetween. The present embodiment adopts a mechanism in which the folding roller 83 is pressed against the folding roller 82 by a biasing member such as a spring.

Hereinafter, a pairing of the folding rollers 81 and 82 is referred to as a first pair of folding rollers 8*a*, and a pairing of the folding rollers 82 and 83 is referred to as a second pair of folding rollers 8*b*.

The conveyance roller 84 is in contact with the folding roller 83, and conveys a sheet after triple folding has been performed thereon.

The first folding knife unit 85 includes a folding knife 85*a*, which is located opposite the nip N1 of the first pair of folding rollers 8*a* such that the conveyance path 79 is therebetween. The first folding knife unit 85 moves the folding knife 85*a* toward the nip N1 in a direction indicated by arrow D, thus performing a pressing operation on a sheet S stored in the sheet stacker 27, by pressing a portion of the sheet S corresponding to the target folding position α (FIGS. 2A and 2B) into the nip N1 of the first pair of folding rollers 8*a*.

Through the above, the portion of the sheet S corresponding to the target folding position α is pulled into the nip N1 by rotation of the first pair of folding rollers 8*a*, and pressing force applied by the folding rollers 81 and 82 composing the first pair of folding rollers 8*a* causes double folding of the sheet S at the target folding position α.

The second folding knife unit 86 includes a folding knife 201 (equivalent to a pressing member), which is located opposite the nip N2 of the second pair of folding rollers 8*b* such that a conveyance path 99, along which the sheet S is conveyed after passing through the nip N1 of the first pair of folding rollers 8*a*, is located therebetween. During triple folding the second folding knife unit 86 moves the folding knife 201 in a direction indicated by arrow E (equivalent to a pressing direction), thus performing a pressing operation on the sheet S, which has already been folded at the target folding position α, by pressing a portion of the sheet S corresponding to the target folding position β (FIG. 2B) into the nip N2 of the second pair of folding rollers 8*b*.

Through the above, the portion of the sheet S corresponding to the target folding position β is pulled into the nip N2 by rotation of the second pair of folding rollers 8*b*, and pressing force applied by the folding rollers 82 and 83 composing the second pair of folding rollers 8*b* causes folding of the sheet S at the target folding position β.

Note that each of the rollers, such as the folding roller 81, are approximately equal to one another in terms of length in an axial direction thereof (i.e., length in a sheet width direction). Also note that the folding knives 85*a* and 201 are approximately equal to one another in terms of length in the sheet width direction, and are each slightly shorter than each of the rollers in terms of length in the sheet width direction.

The heating member 87 is supported by the folding knife 201. When the leading edge of the fold portion of the sheet S is to be heated downstream of the first pair of folding rollers 8*a* in terms of the sheet conveyance direction, after passing through the nip N1 of the first pair of folding rollers 8*a*, the heating member 87 is lowered in accompaniment to the folding knife 201 from a standby position indicated in FIG. 3 to a heating position indicated in FIG. 14.

The conveyance path switching claw 88 switches direction of the conveyance path 99 for double folding and triple folding. During double folding the conveyance path switching claw 88 is orientated as indicated by a solid line in FIG. 3 and during triple folding the conveyance path switching claw 88 is orientated as indicated by a broken line in FIG. 3.

The ejection rollers 89 convey the sheet S after double folding thereof, ejecting the sheet S onto the ejection tray 29*c*.

Figure 9:
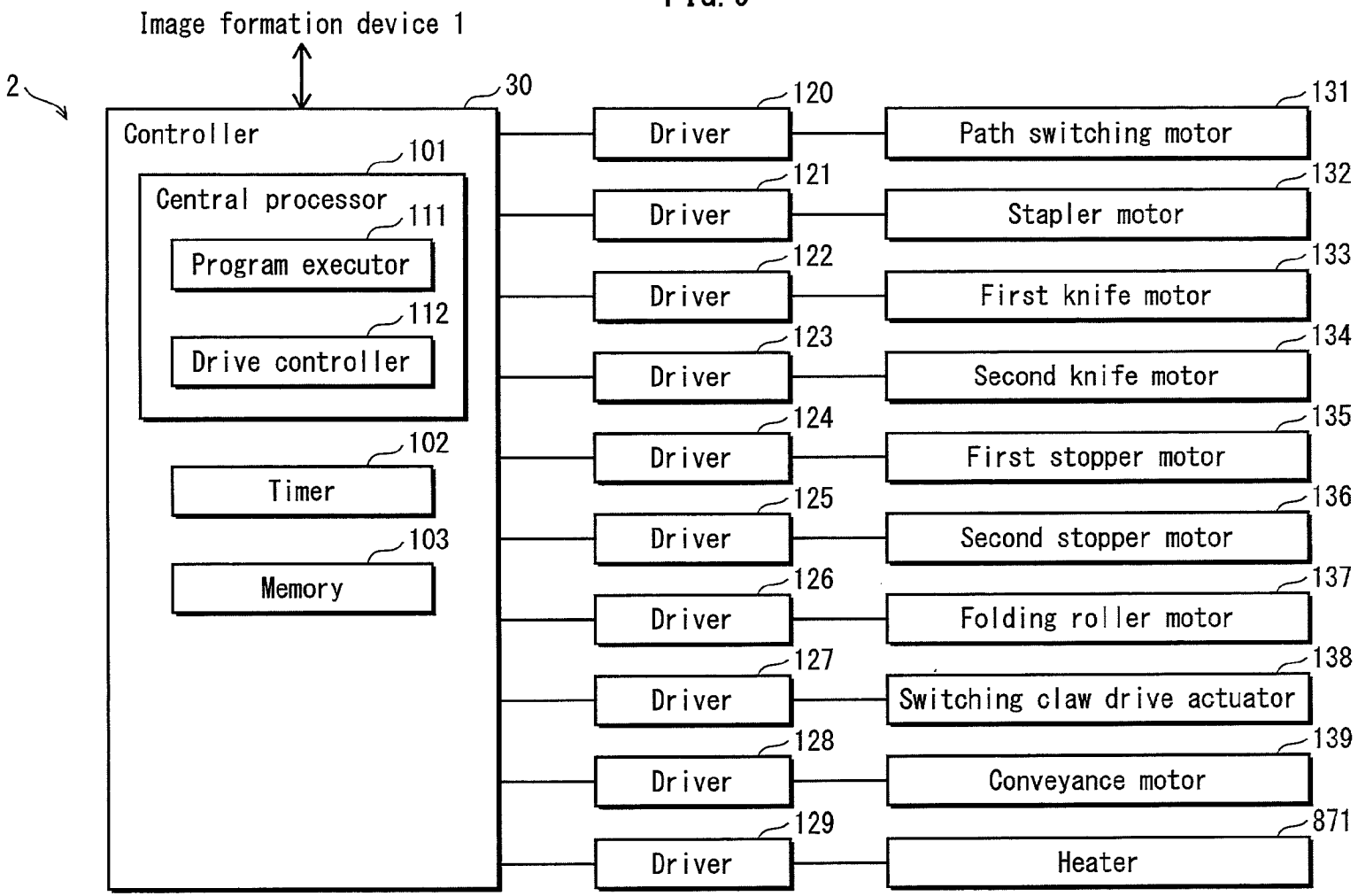
FIG. 9 is a block diagram illustrating configuration of a controller of the after-processing device.

In the present embodiment, the folding rollers 81-83, the conveyance roller 84, and the ejection rollers 89 included in the sheet folder 28, are each rotationally driven by a folding roller motor 137 (FIG. 9).

[Double Folding Operation]

Figure 4:
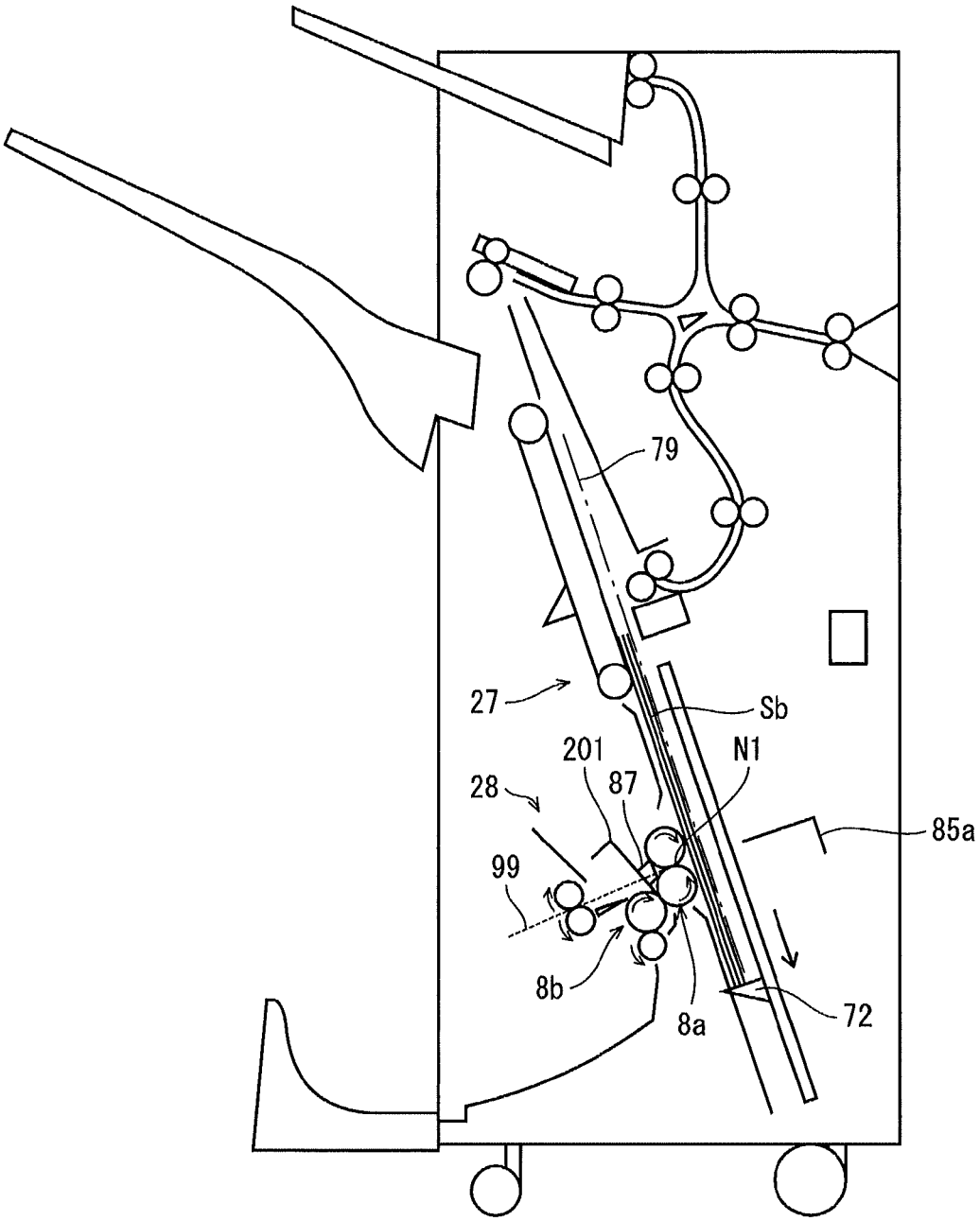
FIG. 4 illustrates operation during double folding.
Figure 5:
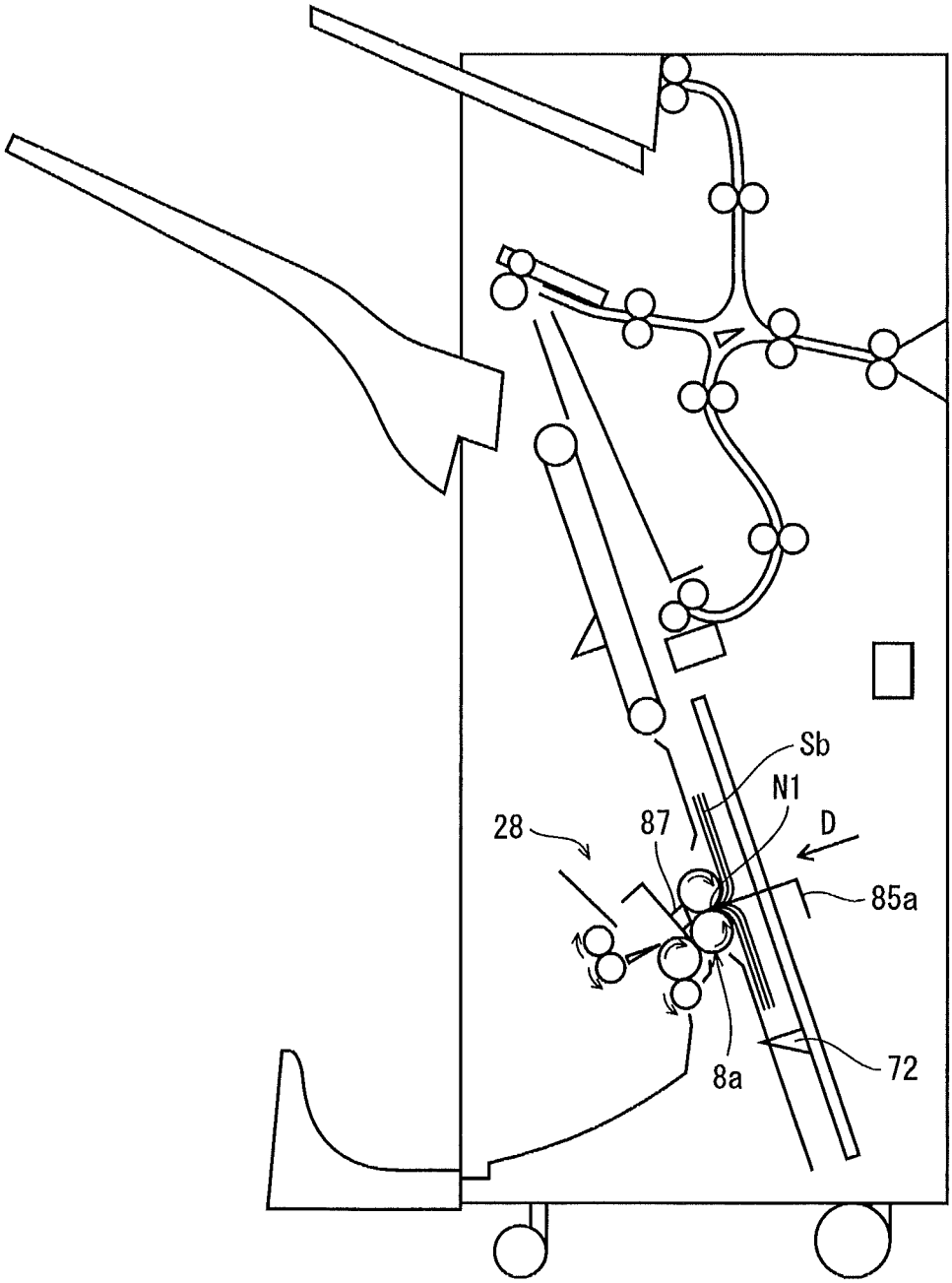
FIG. 5 illustrates operation during double folding.

FIGS. 4-7 are diagrams for explaining double folding operation,

FIG. 4 illustrates a state prior to pressing operation of the folding knife 85*a* in which a sheet bundle Sb, consisting of a plurality of sheets S, is stored in the sheet stacker 27, and in which the heating member 87 is held at the heating position while each of the rollers, such as the first pair of folding rollers 8*a*, rotates.

When pressing operation of the folding knife 85*a* commences in the state described above, as illustrated in FIG. 5, a portion of the sheet bundle Sb corresponding to the target folding position α is pressed by the folding knife 85*a* into the nip N1 of the first pair of folding rollers 8*a* which are rotating. Through the above, a fold is created in the sheet bundle Sb at the target folding position α. The folding knife 85*a* subsequently returns to an original position thereof.

Figure 6:
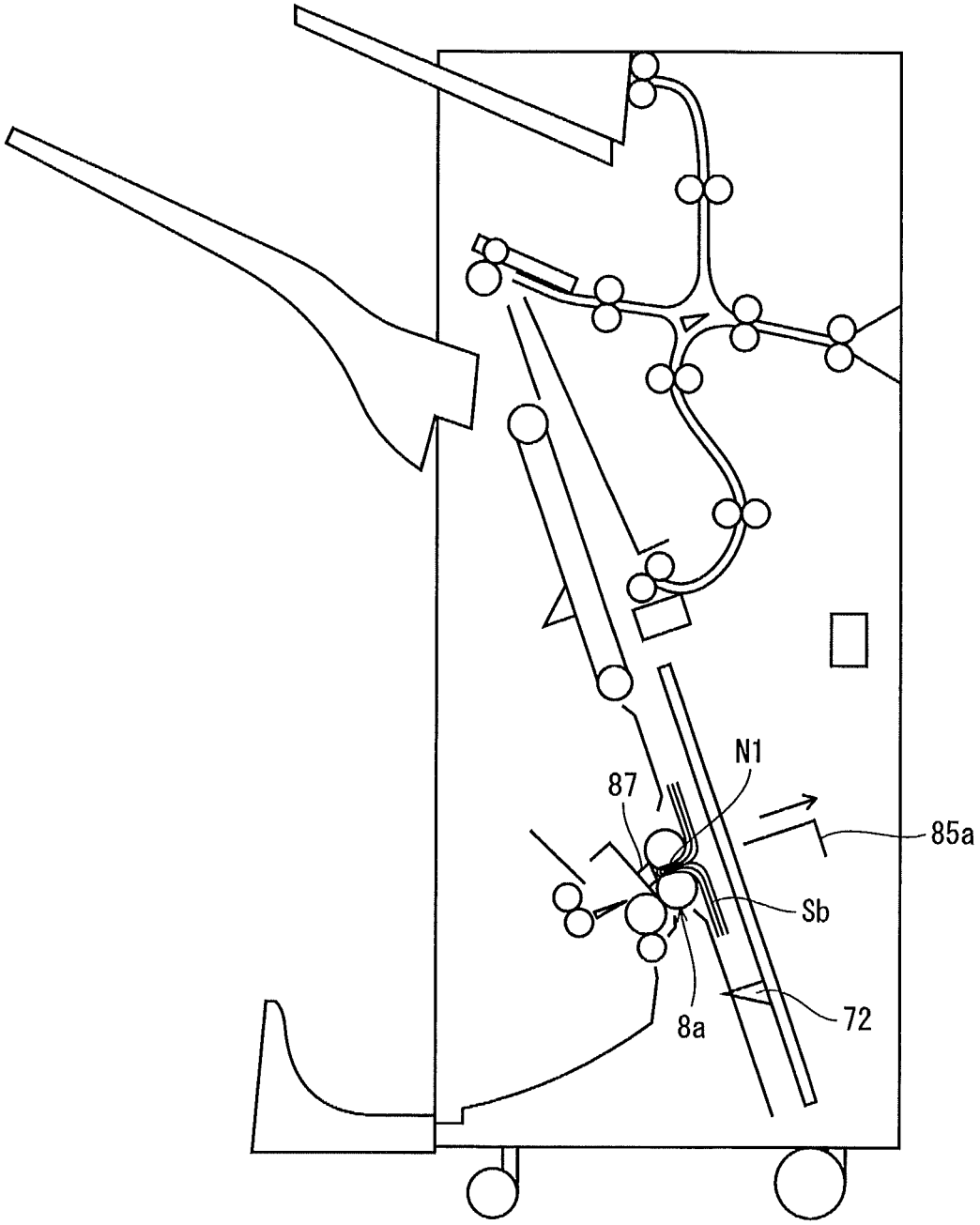
FIG. 6 illustrates operation during double folding.

Continued rotation of the first pair of folding rollers 8*a* causes conveyance of the sheet bundle Sb, which has been folded at the target folding position α. The sheet bundle Sb is conveyed with an edge of a fold portion as a leading edge of the sheet bundle Sb. After the leading edge of the sheet bundle Sb has passed through the nip N1, rotation of each of the rollers, such as the first pair of folding rollers 8*a*, is temporarily suspended once a predetermined period of time Tx has elapsed since commencement of the pressing operation by the folding knife 85*a* (FIG. 6).

During the temporary suspension of rotation, the leading edge of the fold portion of the sheet bundle Sb is heated by the heating member 87 while in contact therewith. Heating time (Ty) may for example be approximately 10 to 20 seconds. An appropriate heating time is predetermined for each sheet bundle in accordance with factors such as sheet type and sheet number of the sheet bundle.

Figure 7:
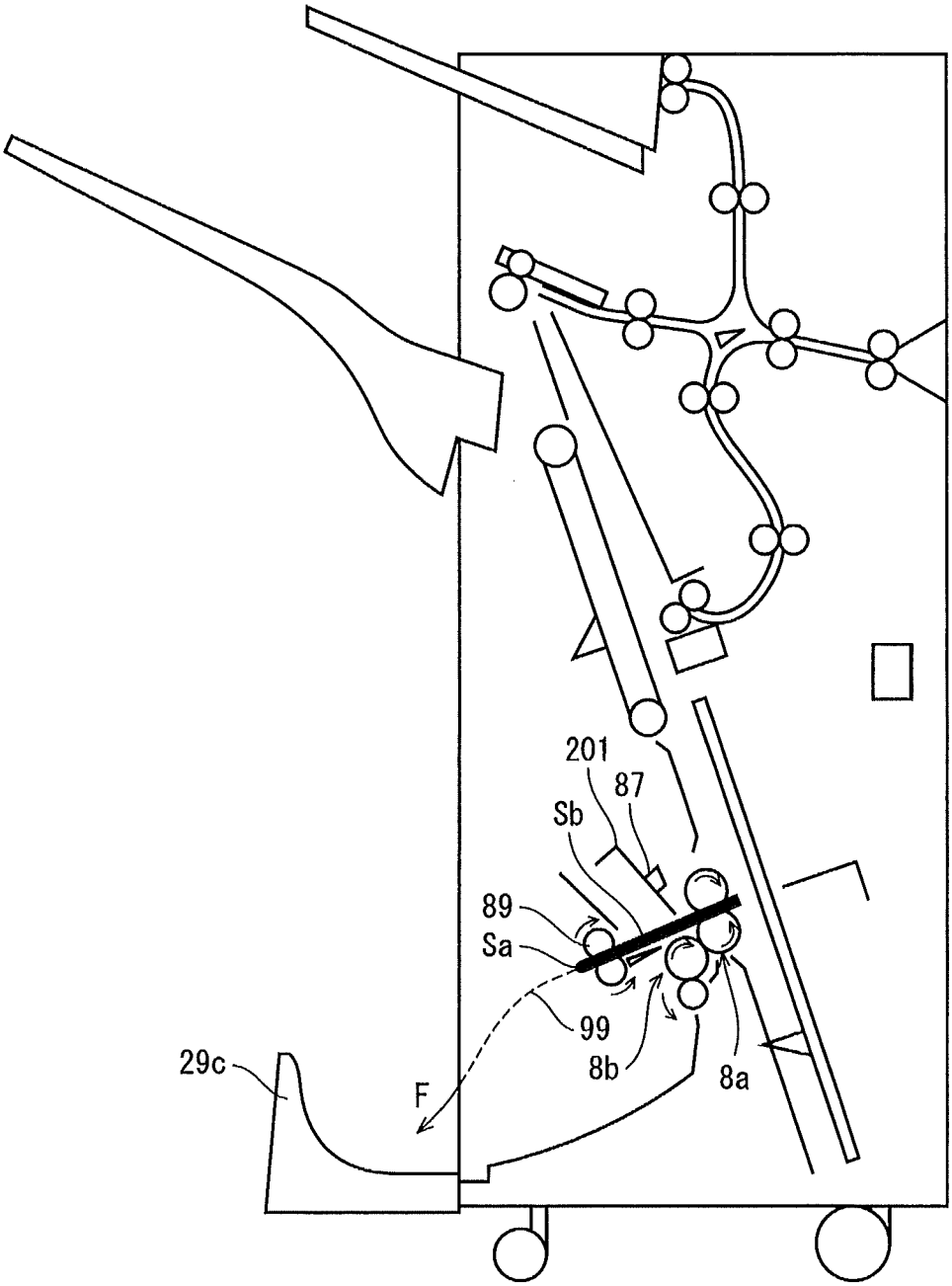
FIG. 7 illustrates operation during double folding.

Once heating of the leading edge of the fold portion is complete, the heating member 87 is returned to the standby position as illustrated in FIG. 7, and rotation of each of the rollers, such as the first pair of folding rollers 8*a*, is recommenced.

Through the above, the sheet bundle Sb which has been double folded at the target folding position α is conveyed by the first pair of folding rollers 8*a*, along the conveyance path 99 to the ejection rollers 89, with an edge Sa of the sheet bundle Sb as a leading edge. The ejection rollers 89 subsequently eject the sheet bundle Sb toward the ejection tray 29*c* in a direction indicated by arrow F.

[Triple Folding Operation]

Figure 8A:
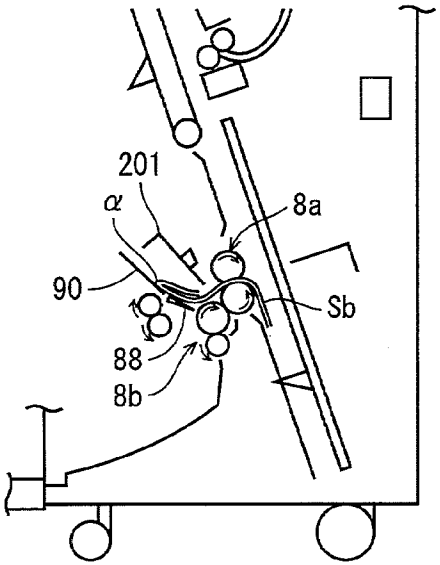
FIG. 8A illustrates operation during triple folding when a sheet bundle folded at a target folding position α is conveyed by a first pair of folding rollers.
Figure 8B:
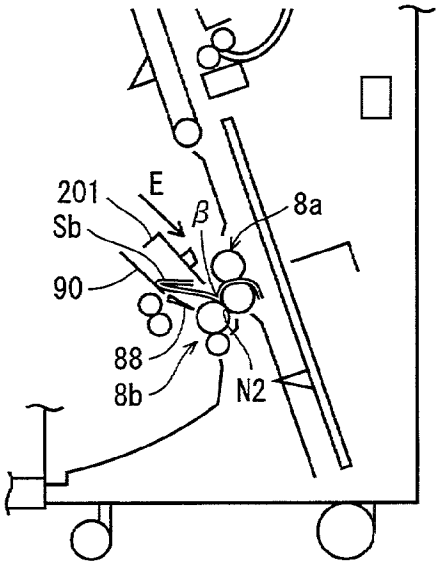
FIG. 8B illustrates operation during triple folding when a target folding position β of the sheet bundle is at a predetermined position opposite a nip of a second pair of folding rollers.
Figure 8C:
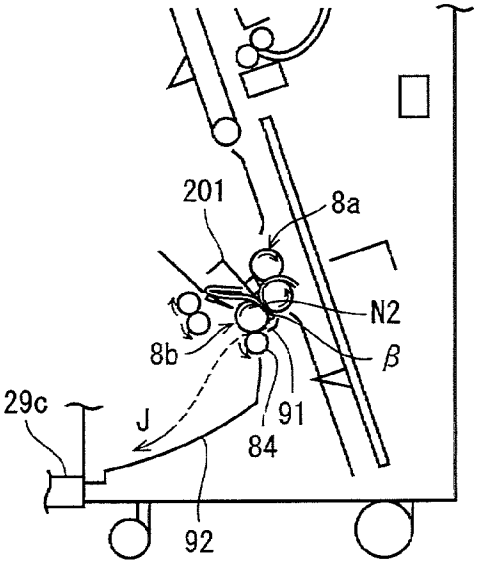
FIG. 8C illustrates operation during triple folding when pressing operation of a folding knife commences in the state illustrated in FIG. 8B.

FIGS. 8A-8C are diagrams for explaining triple folding operation.

FIG. 8A illustrates appearance when a sheet bundle Sb, which has already been folded at the target folding position α, is conveyed by the first pair of folding rollers 8*a* and is guided along a guide 90 by the conveyance path switching claw 88, which has been switched to the orientation for triple folding.

FIG. 8B illustrates appearance when rotation of each of the rollers, such as the first pair of folding rollers 8*a*, is suspended with the target folding position β of the sheet bundle Sb located at a predetermined position opposite the nip N2 of the second pair of folding rollers 8*b*.

FIG. 8C illustrates appearance when rotation of each of the rollers, such as the second pair of folding rollers 8*b*, is recommenced in response to a portion of the sheet bundle SU corresponding to the target folding position β being pressed into the nip N2 of the second pair of folding rollers 8*b*. The above occurs as a result of pressing operation of the folding knife 201 commencing while in the state illustrated in FIG. 8B.

Recommencement of rotation of the second pair of folding rollers 8*b* causes the portion of the sheet bundle Sb corresponding to the target folding position β to be pulled into the nip N2 of the second pair of folding rollers 8*b*, creating a fold at the target folding position β. The folding knife 201 subsequently returns to an original position thereof.

Continued rotation of each of the rollers, such as the second pair of folding rollers 8*b*, causes the sheet bundle Sb, which has been triply folded, to be guided to the conveyance roller 84 along the guide 91. The sheet bundle Sb is conveyed with the target folding position β as a leading edge of the sheet bundle Sb. The conveyance roller 84 and the folding roller 83 convey the sheet bundle Sb along the guide 92 in a direction indicated by arrow J, thus conveying the sheet bundle Sb to the ejection tray 29*c* which stores the sheet bundle Sb thereon.

Note that an openable cover 31 (FIG. 1) is provided on a side surface of the after-processing device 2 corresponding to a sheet ejection side thereof. The openable cover 31 has a function of covering or exposing an internal part of the after-processing device 2. The after-processing device 2 is configured such that if a jam occurs during conveyance of the sheet bundle Sb after folding thereof, a user is able to remove the jammed sheet bundle Sb by opening the openable cover 31, and inserting a hand into the internal part of the after-processing device 2 from a side thereof corresponding to the ejection tray 29*c*.

The above describes operation during double folding and triple folding of a sheet bundle Sb consisting of a plurality of sheets S, but folding operation can for example also be performed on a single sheet S using the same method.

(5) Configuration of Controller 30

FIG. 9 is a block diagram illustrating configuration of the controller 30.

As illustrated in FIG. 9, the controller 30 includes a central processor 101, a timer 102, and a memory 103.

The central processor 101 includes a program executor 111 and drive controller 112. The central processor 101 ensures smooth execution of after-processing on one or more sheets S, such as stapling or sheet folding, by performing unified control of each of the configuration elements of the after-processing device 2, such as the sheet injector 21, the conveyance path switcher 22, the sheet conveyance parts 23-25, the stapler 26, the sheet stacker 27, and the sheet folder 28.

The program executor 111 executes a predetermined program for performing after-processing in the after-processing device 2.

The drive controller 112 controls a path switching motor 131, a stapler motor 132, a first knife motor 133, a second knife motor 134, a first stopper motor 135, a second stopper motor 136, a folding roller motor 137, a switching claw drive actuator 138, a conveyance motor 139, and a heater 871 by outputting control signals to drivers 120-129, which respectively drive the above listed elements.

The path switching motor 131 is used to drive the switching claw 22*a* (FIG. 3), which switches between the conveyance paths 51-53.

The stapler motor 132 is used to bind a sheet bundle by driving a staple clincher of the stapler 26 (i.e., a part of the stapler that inserts a staple; not illustrated) to insert a staple into the sheet bundle.

The first knife motor 133 is used to execute the operation of pressing a portion of a sheet S corresponding to the target folding position α into the nip N1 of the first pair of folding rollers 8*a*, by providing driving force to the folding knife 85*a*.

In terms of a drive mechanism for providing driving force to the folding knife 85*a*, a cam mechanism may for example be used in order to convert rotary driving force of the first knife motor 133 into linear force for causing linear back-and-forth motion of the folding knife 85*a*. Alternatively, a direct drive motor can be used.

The second knife motor 134 is used to execute the operation of pressing a portion of a sheet S corresponding to the target folding position β into the nip N2 of the second pair of folding rollers 8*b* during triple folding, by providing driving force to the folding knife 201. The second knife motor 134 is also used to provide driving force to the folding knife 201 in order to, when a leading edge of a sheet S is to be heated after folding by the folding knife 85*a*, move the heating member 87 from the standby position to the heating position.

In the same way as described above, a cam mechanism or a direct drive motor can be used as a drive mechanism for providing driving force to the folding knife 201. Note that the drive mechanism has a configuration such that positioning of the folding knife 201 is switchable between a first position at which the heating member 87 is separated from the conveyance path 99 at the standby position, a second position at which the heating member 87 is held on the conveyance path 99 at the heating position, and a third position at which the folding knife 201 presses the sheet S into the nip N2 of the second pair of folding rollers 8*b*. Detailed description of the above configuration is provided further below.

The first stopper motor 135 is used to move the stopper 71, and the second stopper motor 136 is used to move the stopper 72.

The folding roller motor 137 is used to rotationally drive each of the rollers included in the sheet folder 28, such as the folding roller 81.

The switching claw drive actuator 138 is an actuator used to drive the conveyance path switching claw 88, and may for example be implemented using a solenoid.

The conveyance motor 139 is used to rotationally drive rollers which are not included in the sheet folder 28, such as the conveyance rollers 41 and 42.

The heater 871 is a part of the heating member 87 which is used as a heat source when heating a leading edge Sa of a fold portion of a sheet S, after the sheet S has been folded at the target folding position α.

The timer 102 is used as a clock for the aforementioned predetermined time Tx and the heating time Ty.

The memory 103 stores therein a program executed by the program executor 111, data required for executing the program, and information such as the predetermined time Tx and the heating time Ty.

The central processor 101 is configured such as to be in communication with the image formation device 1. The central processor 101 receives an execution instruction for after-processing (for example, stapling, double folding, or triple folding) and information, such as sheet size and sheet number on which after-processing is to be performed, from the image formation device 1. The central processor 101 executes after-processing based on the instruction and the information. Note that alternatively the after-processing device 2 may include a reception unit for receiving an operation by the user inputting the aforementioned information, and thus the aforementioned information may be obtained from the reception unit instead of from the image formation device 1.

Note that the central processor 101 includes a processor such as a central processing unit (CPU) or a micro processing unit (MPU).

(6) Configuration of the Second Folding Knife Unit 86 and the Heating Member 87.

Figure 10:
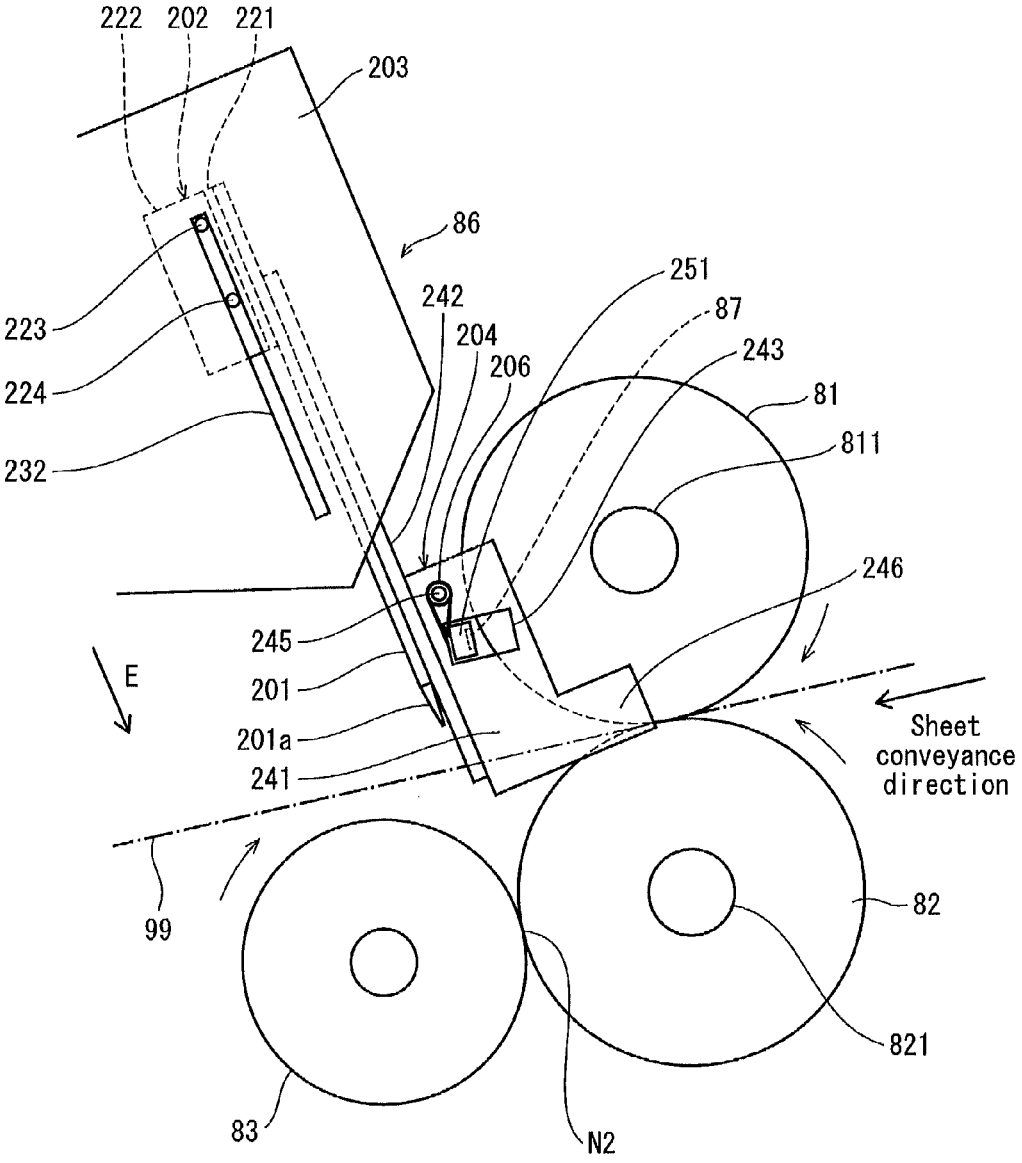
FIG. 10 is an enlarged front-view diagram illustrating configuration of a second folding knife unit and a heating member, viewed from a front side of the after-processing device.
Figure 11:
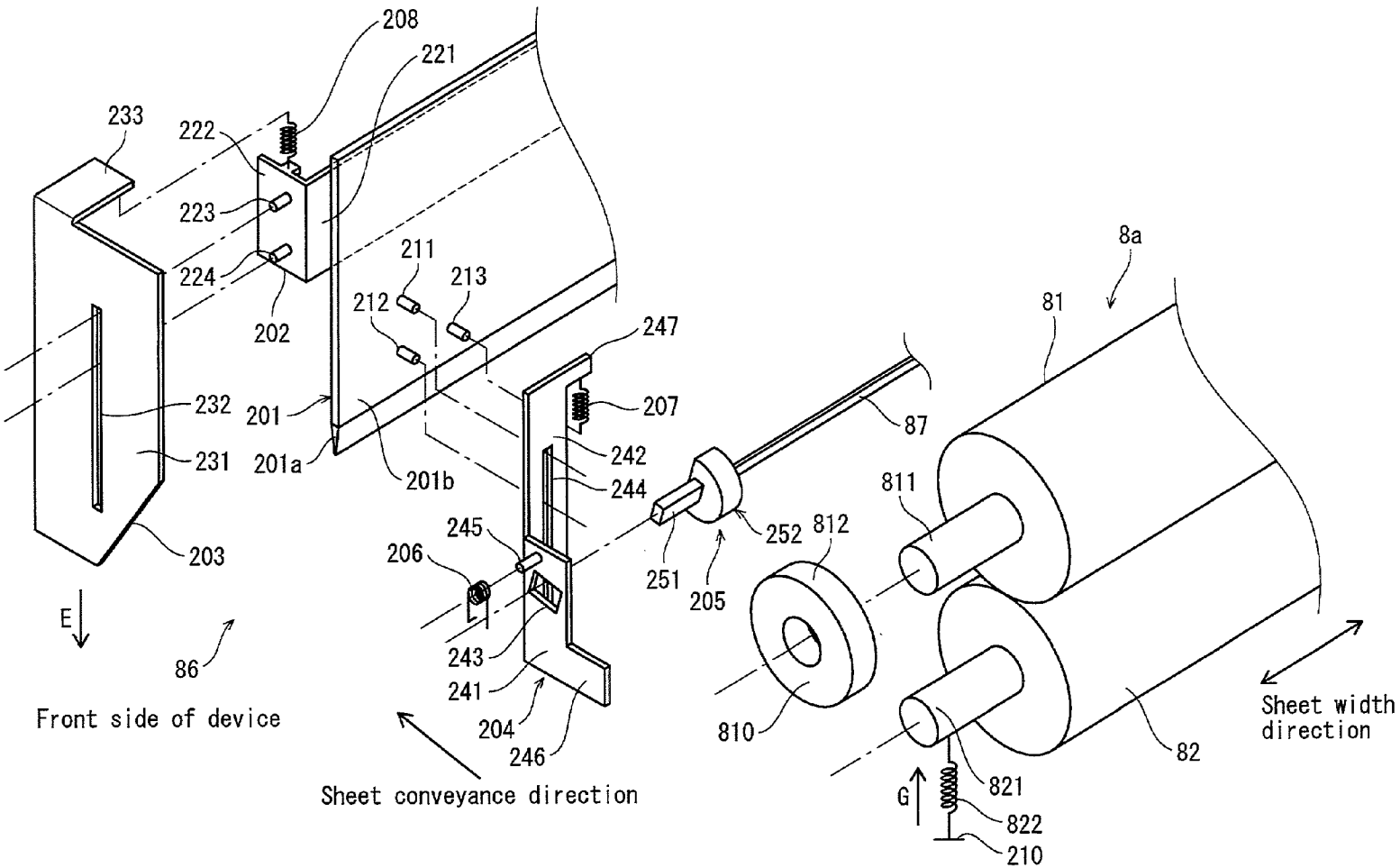
FIG. 11 is an exploded perspective diagram illustrating the second folding knife unit and the heating member.
Figure 12A:
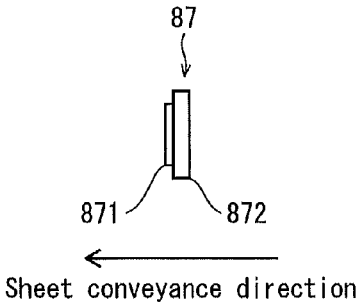
FIG. 12A is an enlarged diagram of the heating member.
Figure 12B:
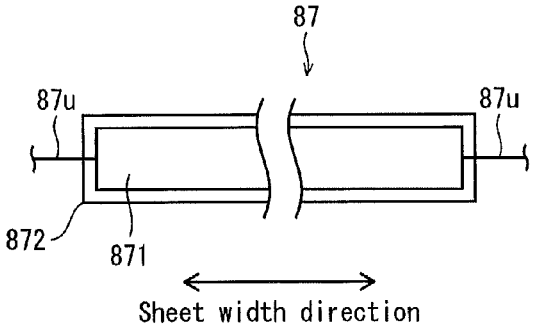
FIG. 12B is an enlarged diagram of the heating member, viewed from a different direction to FIG. 12A.

FIG. 10 is an enlarged front-view diagram illustrating configuration of the second folding knife unit 86 and the heating member 87 when viewed from in front of the after-processing device 2 while the heating member 87 is in the standby position. FIG. 11 is an exploded perspective diagram illustrating configuration of the second folding knife unit 86 and the heating member 87. FIGS. 12A and 12B are enlarged diagrams of the heating member 87.

As illustrated in FIGS. 10 and 11, the second folding knife unit 86 includes the folding knife 201, a knife fixing part 202, knife supporting parts 203, first heater supporting parts 204, second heater supporting parts 205, torsion springs 206, and tension springs 207 and 208.

Note that the front-view diagram in FIG. 10 only illustrates configuration elements which are necessary for explanation of positional relationship of the folding knife 201, the heating member 87, and the folding rollers 81-83. The same applies to other front-view diagrams explained further below. Also note that the exploded perspective diagram in FIG. 11 only illustrates configuration of one end of the second folding knife unit 86 in terms of the sheet width direction (i.e., an end of the second folding knife unit 86 closest to the front of the after-processing device 2). Configuration of the other end of the second folding knife unit 86 (i.e., an end of the second folding knife unit 86 closest to the rear of the after-processing device 2) is omitted. Configuration of the other end of the second folding knife unit 86 is fundamentally the same as configuration of the one end of the second folding knife unit 86.

The folding knife 201 has an elongated shape in the sheet width direction. A blade 201*a* is provided at a bottom edge of the folding knife 201.

The knife fixing part 202 includes a fixing plate 221 which has an elongated shape in the sheet width direction, and bent plates 222 which are bent in the sheet conveyance direction and which are provided at opposite ends of the fixing plate 221 to one another. The folding knife 201 is fixed to the fixing plate 221 of the knife fixing part 202 such that a main surface 201*b* of the folding knife 201 is orientated in parallel to the sheet width direction.

The knife supporting parts 203 are plate shaped and are located at opposite ends of the knife fixing part 202 to one another, in terms of the sheet width direction. Each of the knife supporting parts 203 is fixed to a device housing (not illustrated) such that a main surface 231 of the knife supporting part 203 is orientated perpendicularly to the sheet width direction.

An elongated slit 232 is provided in the main surface 231 of the knife supporting part 203 in a direction indicated by arrow E. Pins 223 and 224 provided on a corresponding one of the bent plates 222 of the knife fixing part 202 fit into the elongated slit 232 in the knife supporting part 203. Through the above configuration, the knife fixing part 202 is supported in a manner such as to be freely moveable relative to the knife supporting part 203 in the direction indicated by arrow E.

Each of the knife supporting parts 203 includes a bent plate 233 at a top edge thereof. The bent plate 233 is bent in a direction toward the knife fixing part 202. The bent plate 233 of the knife supporting part 203 is linked to a corresponding one of the bent plates 222 of the knife fixing part 202 through one of the tension springs 208.

Tensile force of the tension spring 208 biases the folding knife 201, which is fixed to the knife fixing part 202, in an opposite direction to the direction indicated by arrow E, relative to the knife supporting part 203.

One of the first heater supporting parts 204 and one of the second heater supporting parts 205 are located at one end of the heating member 87, which has an elongated shape in the sheet width direction, and the other of the first heater supporting parts 204 and the other of the second heater supporting parts 205 are located at an opposite end of the heating member 87.

Each of the first heater supporting parts 204 is located upstream relative to the folding knife 201 in terms of the sheet conveyance direction. The first heater supporting part 204 is L-shaped and includes a first supporting plate 241, which is parallel to the sheet conveyance direction, and a second supporting plate 242, which is perpendicular to the first supporting plate 242.

The second supporting plate 242 is parallel to the main surface 201*b* of the folding knife 201, and has an elongated slit 244 provided therein in the direction indicated by arrow E. Pins 211 and 212 provided on the main surface 201*b* of the folding knife 201 fit into the elongated slit 244 in the second supporting plate 242. Through the above configuration, the first heater supporting part 204 is supported in a manner such as to be freely moveable in the direction indicated by arrow E, relative to the folding knife 201.

An upper edge 247 of the second supporting plate 242 is linked through one of the tension springs 207 to a pin 213 provided on the main surface 201*b* of the folding knife 201. Tensile force of the tension spring 207 biases the first heater supporting part 204 in the direction indicated by arrow E, relative to the folding knife 201.

The first supporting plate 241 of the first heater supporting part 204 has, in a central portion thereof, a long opening 243 extending in the sheet conveyance direction. An engaging member 251 of the second heater supporting part 205 fits into the long opening 243. Through the above configuration, the second heater supporting part 205 is supported in a manner such as to be freely moveable in the sheet conveyance direction, relative to the first heater supporting part 204.

The first heater supporting part 204 includes an extended section 246 which extends in the opposite direction to the sheet conveyance direction from an upstream edge of a lower portion of the first supporting plate 241. The first heater supporting part 204 also includes a protrusion 245 which protrudes from an upper portion of the first supporting plate 241.

A corresponding one of the torsion springs 206 is fitted onto the protrusion 245. One end of the torsion spring 206 engages with the long opening 243 and another end of the torsion spring 206 engages with the engaging member 251 of the second heater supporting part 205, which fits into the long opening 243 (FIG. 10). Force applied by the torsion spring 206 in an opening direction thereof, biases the second heater supporting part 205 in the opposite direction to the sheet conveyance direction, relative to the first heater supporting part 204.

The second heater supporting part 205 is composed of the engaging member 251 and a fixing member 252.

The engaging member 251 has a rod-shaped rectangular lateral cross-section. One end of the engaging member 251 engages with the long opening 243 in the first heater supporting part 204 and an opposite end of the engaging member 251 is fixed to the fixing member 252.

The fixing member 252 has an approximately semicircular shape with a diameter larger than the engaging member 251. The heating member 87 is supported by the fixing member 252 by fixing a corresponding end of the heating member 87, in terms of the sheet width direction, to a surface of the fixing member 252 on an opposite side of the fixing member 252 relative to a side at which the engaging member 251 is fixed.

As illustrated in FIGS. 12A and 12B, the heating member 87 has an elongated shape in the sheet width direction, and includes the heater 871 and a substrate 872. The heater 871 has a thin thickness. More specifically, the heating member 87 has a length in the sheet width direction which is greater than a maximum sheet size. For example, the heating member 87 may have a length of approximately 350 mm, which is greater than width of an A4 sheet, a width of approximately 5 mm, and a thickness of approximately 0.5 mm to 0.6 mm.

The heater 871 may for example be a so called polyimide heater in which a heating element, such as stainless steel or nickel alloy, having thickness of an order of tens of micrometers, is sandwiched between two polyimide films, each having thickness of an order of tens of micrometers. The type of heater described above has low electricity consumption, while also having favorable thermal responsiveness due to rapid heating being possible as a result of low heat capacity. Therefore, the heater is suitable for localized heating of a leading edge of a fold portion of a sheet.

Each end of the heater 871 in terms of the sheet width direction is connected to a lead 87*u*, and each of the leads 87*u* is connected to the driver 129 (FIG. 9). Electrical power is supplied to the heater 871 from the driver 129 via the leads 87*u*, causing the heating element of the heater 871 to generate heat (i.e., the heater is switched on). Note that the heater 871 is not limited to being a polyimide heater, and may alternatively be a different type of heater.

The substrate 872 is for example a thin aluminum plate of approximately 0.5 mm in thickness. The substrate 872 functions as a fixed support that prevents warping of the heater 871, which has a smaller thickness than the substrate 872. Note that the heater 871 and the substrate 872 are not limited to a positional relationship in which the heater 871 is located further downstream than the substrate 872 in terms of the sheet conveyance direction. For example, alternatively positional relationship of the heater 871 and the substrate 872 may be reversed relative to the positional relationship described above.

Returning to explanation of FIG. 11, two pitch rings 810 engage with opposite ends of a rotational axle 811 of the folding roller 81 to one another.

Each of the pitch rings 810 has an annular shape and is fitted onto the rotational axle 811 of the folding roller 81. The pitch rings 810 are provided in order to separate the heating member 87 from a circumferential surface of the folding roller 81 when the heating member 87 is located at the standby position. Detailed description of a configuration by which separation is achieved is provided further below.

A rotational axle 821 of the folding roller 82 is linked to a device housing 210 through compression springs 822. The folding roller 82 is pressed toward the folding roller 81 through a force applied by each of the compression spring 822 in a direction indicated by arrow G (i.e., a direction in which distance between the folding roller 81 and 82 decreases). The configuration described above results in application of pressing force at the nip N1, where the folding rollers 81 and 82 are in contact with one another.

Increased thickness of a sheet S or a sheet bundle Sb which is to be double folded causes the folding roller 82 to be displaced away from the folding roller 81, against the force applied by the compression springs 822, increasing inter-axle separation between the folding rollers 81 and 82.

In a configuration such as described above, when the heating member 87 is at the standby position (FIG. 10), driving force from the second knife motor 134 is not provided to the folding knife 201, and thus tensile force applied by the tension springs 208 causes the folding knife 201 to be located at an uppermost position (first position) in a moveable range resulting from the elongated slit 232 in each of the knife supporting parts 203.

Tensile force applied by the tension springs 207 causes each of the first heater supporting parts 204 to be located at a lowermost position in a moveable range resulting from the elongated slit 244, relative to the folding knife 201 in the uppermost position. When the first heater supporting part 204 is located at the lowermost position, the heating member 87 is at the standby position located above the conveyance path 99 as illustrated in FIG. 10.

When the heating member 87 is located at the standby position, the heating member 87 is separated from the folding roller 81 in terms of the sheet conveyance direction. Separation of the heating member 87 from the folding roller 81 in the above configuration is achieved through cooperation between the fixing member 252 of each of the second heater supporting parts 205 and a corresponding one of the pitch rings 810 fitted onto the rotational axle 811 of the folding roller 81.

Figure 13:
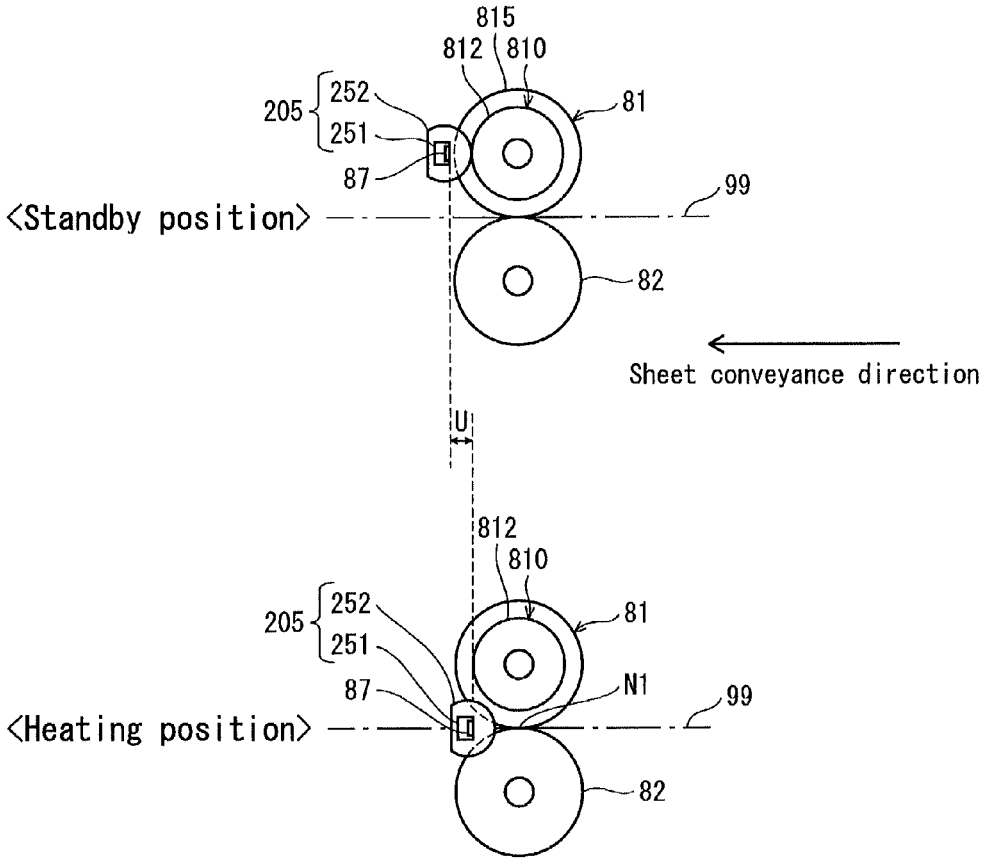
FIG. 13 is a schematic diagram illustrating positional relationship of the heating member, folding rollers, a pitch ring, and a second heater supporting part.

FIG. 13 is a schematic diagram illustrating positional relationship of the folding rollers 81 and 82, one of the pitch rings 810, one of the second heater supporting parts 205, and the heating member 87 when the heating member 87 is located at the standby position, and also when the heating member 87 is located at the heating position. Note that elements other than the aforementioned elements are omitted in FIG. 13.

When the heating member 87 is located at the standby position, the fixing member 252 of the second heater supporting part 205 is in contact with a circumferential surface 812 of the pitch ring 810. As described above, the engaging member 251 of the second heater supporting part 205 engages with the long opening 243 in the corresponding first heater supporting part 204 (FIG. 11), and the second heater supporting part 205 is supported by the first heater supporting part 204 such as to be freely moveable in a longitudinal direction of the long opening 243 (i.e., in the sheet conveyance direction). Also, force applied by the corresponding torsion spring 206 in an opening direction thereof causes biasing of the second heater supporting part 205 in the opposite direction to the sheet conveyance direction.

Magnitude of respective diameters of the fixing member 252 and the pitch ring 810 are determined in advance such that when the fixing member 252 is in contact with the circumferential surface 812 of the pitch ring 810, within the moveable range of the second heater supporting part 205 in the longitudinal direction of the long opening 243 in the first heater supporting part 204, the heating member 87 is caused to separate from a circumferential surface 815 of the folding roller 81 by a predetermined distance. Through the above, when the heating member 87 is located at the standby position illustrated in FIG. 10, the heating member 87 is caused to be a predetermined distance downstream in the sheet conveyance direction relative to the folding roller 81, separated from the folding roller 81 against the force applied by the torsion spring 206.

In contrast to the above, when the heating member 87 moves from the standby position to the heating position, the fixing member 252 of the second heater supporting part 205 separates from the circumferential surface 812 of the pitch ring 810.

The second heater supporting part 205 is biased in the opposite direction to the sheet conveyance direction through the force applied by the corresponding torsion spring 206. Therefore, when the fixing member 252 of the second heater supporting part 205 separates from the pitch ring 810, the heating member 87 moves due to the force applied by the torsion spring 206. The heating member 87 moves, within the moveable range of the long opening 243 in the first heater supporting part 204, to a position closest to the nip N1 between the folding rollers 81 and 82. FIG. 13 illustrates an example in which, when the heating member 87 moves from the standby position to the heating position, movement distance in terms of the sheet conveyance direction is U.

The second knife motor 134 provides driving force to the folding knife 201 in order to move the heating member 87 to the heating position from the standby position illustrated in FIG. 10. The driving force causes lowering of the folding knife 201 in the direction indicated by arrow E, against tensile force applied by the tension springs 208, to a position illustrated in FIG. 14.

Lowering of the folding knife 201 also causes lowering (movement) of each of the first heater supporting part 204 in accompaniment thereto, but during the lowering of the first heater supporting part 204, a bottom edge of the extended section 246 of the first heater supporting part 204 comes into abutment (engages) with the rotational axle 821 of the folding roller 82, restricting further lowering of the first heater supporting part 204.

Lowering of the folding knife 201 continues even when lowering of the first heater supporting part 204 is restricted. Through the above, tensile force applied by the corresponding tension spring 207 illustrated in FIG. 11 acts on the first heater supporting part 204 in the direction indicated by arrow E.

Figure 14:
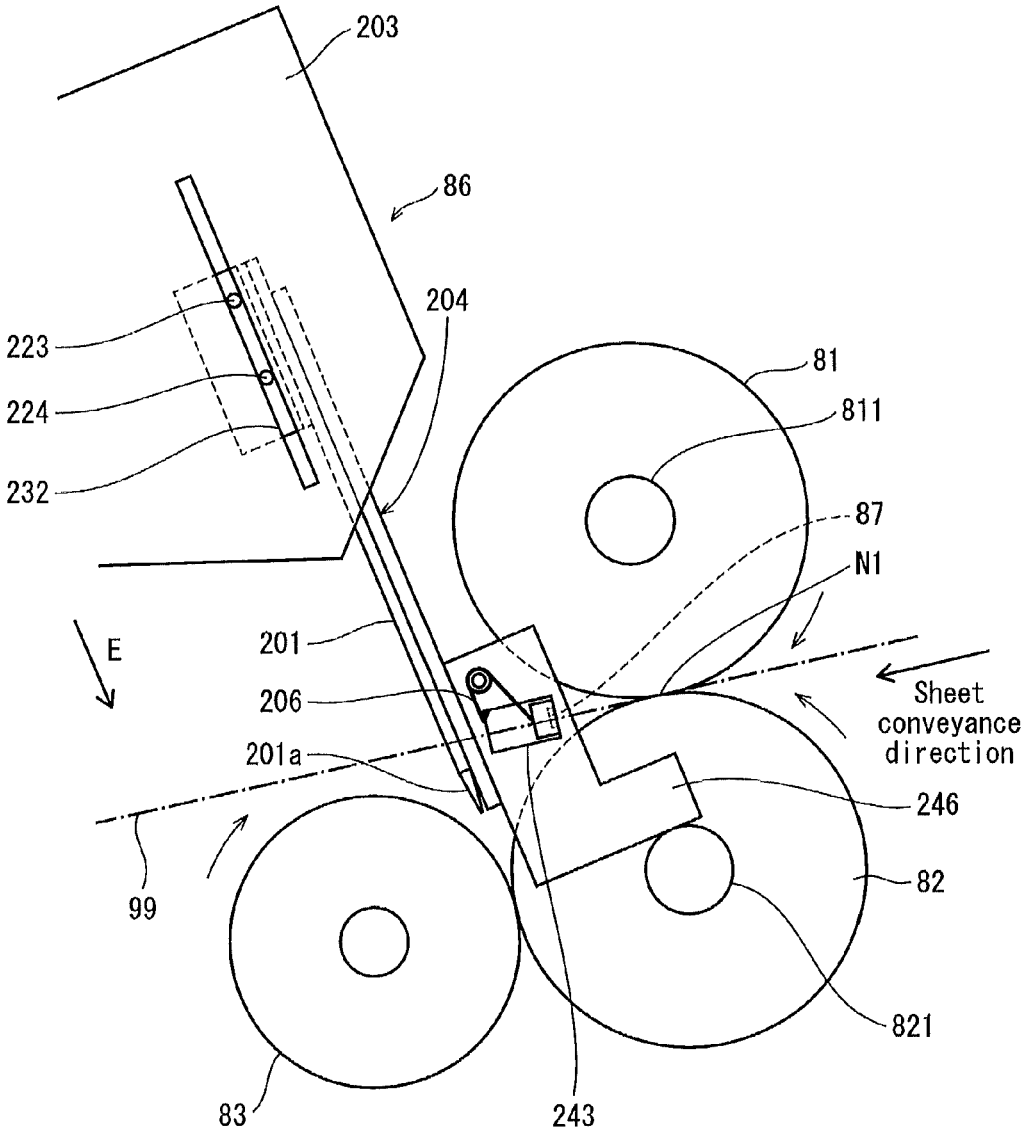
FIG. 14 illustrates appearance of the heating member when located at a heating position.

Once the folding knife 201 has been lowered to the position illustrated in FIG. 14 (second position) and lowering thereof has stopped, the first heater supporting part 204 is in a state in which the lower edge of the extended section 246 is in contact with the rotational axle 821 of the folding roller 82, while tensile force applied by the tension spring 207 is biasing the first heater supporting part 204 in the direction indicated by arrow E. In other words, the first heater supporting part 204 is biased toward the rotational axle 821 of the folding roller 82. Significance of the above is that the tension spring 207 functions as a supporting part biaser which through the second heater supporting part 205, applies a force on the first heater supporting part 204, which supports the heating member 87, in the same direction as a pressing direction of the folding knife 201 (i.e., the direction indicated by arrow E).

Through movement in the state described above, position of the heating member 87, supported by the first heater supporting part 204, is determined relative to the folding roller 82 such that the heating member 87 moves to the heating position without coming into contact with the folding rollers 81 and 82. Significance of the above is that by moving the first heater supporting part 204 which is a supporting unit that supports the heating member 87, the second knife motor 134 functions as a switching part that causes switching of the heating member 87 between the heating position and the standby position.

When a sheet bundle Sb passes through the nip N1 between the folding rollers 81 and 82 with a fold portion as a leading edge thereof, after folding at the target folding position α, the heating member 87 performs heating on the leading edge of the sheet bundle Sb, while being held at the heating position, as explained in detail in section (7) below.

Note that when the folding roller 82 is used as a position determining part for the first heater supporting parts 204, tensile force of the tension springs 207 which bias the first heater supporting parts 204, and restoring force of the compression springs 822 which bias the folding roller 802 are predetermined such that the folding roller 82 is not displaced away from the folding roller 81 as a result of pressing force applied by the first heater supporting parts 204 on the rotational axle 821 of the folding roller 82.

(7) Detailed Explanation of Heating by Heating Member 87

FIGS. 15A-15D are schematic diagrams illustrating, in temporal order, appearance during heating of a sheet bundle Sb by the heating member 87.

Note that in FIGS. 15A-15D, heating position of the heating member 87 is illustrated as being further downstream in the sheet conveyance direction than an actual position thereof, in order to facilitate understanding of positional relationship of the heating member 87 and the sheet bundle Sb which is being conveyed.

Figure 15A:
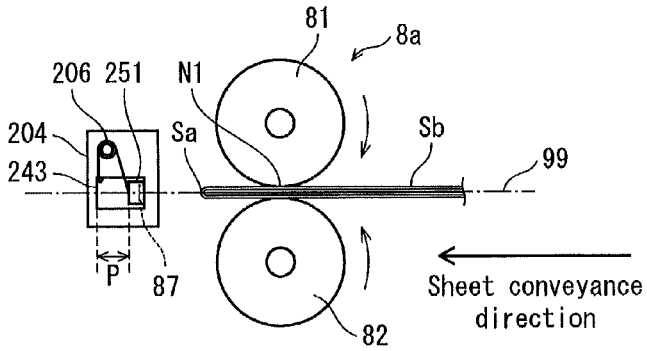
FIG. 15A is a schematic diagram illustrating heating of a sheet bundle by the heating member at time t1.

FIG. 15A illustrates a state in which the sheet bundle Sb, which has been double folded, is conveyed by the first pair of folding rollers 8*a* (folding rollers 81 and 82), along the conveyance path 99, toward the heating member 87 at the heating position with an edge of a fold portion of the sheet bundle Sb as a leading edge Sa (time t1).

Figure 15B:
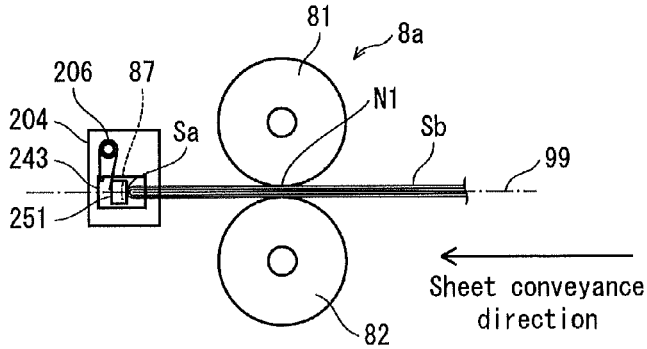
FIG. 15B is a schematic diagram illustrating heating of the sheet bundle by the heating member at time t2.

FIG. 15B illustrates a state in which, after double folding of the sheet bundle Sb, conveyance of the sheet bundle Sb is suspended with the leading edge Sa of the fold portion in contact with the heating member 87 (time t2). Conveyance of the sheet bundle Sb is suspended by suspending supply of electricity to the folding roller motor 137, and thus suspending rotation of the first pair of folding rollers 8*a*.

In FIG. 15B, the heating member 87 is stationary at a position shifted downstream in the sheet conveyance direction relative to a position of the heating member 87 illustrated in FIG. 15A. The shift in position described above is due to the sheet bundle Sb pressing against the heating member 87 during conveyance, once the leading edge Sa of the sheet bundle Sb is in contact with the heating member 87. While the leading edge Sa of the sheet bundle Sb is in contact with the heating member 87, the heating member 87 moves in the sheet conveyance direction, within the moveable range of the long opening 243 in each of the first heater supporting parts 204, against the force applied in the opening direction of the torsion spring 206, until conveyance of the sheet bundle Sb is suspended.

As described above, the heating member 87 is supported in a manner such is to be freely moveable in the sheet conveyance direction while the sheet bundle Sb is in contact therewith. Such a configuration is adopted in order to absorb the effect of variation in conveyance distance of the sheet bundle Sb by the first pair of folding rollers 8*a* after folding thereof.

In other words, pressing force applied in the nip N1 of the first pair of folding rollers 8*a* in order to fold the sheet bundle Sb, varies depending on factors such as sheet thickness, sheet type and sheet number of the sheet bundle Sb as described further above. Furthermore, the pressing force increases when the folding knife 85*a* pushes a portion of the sheet bundle Sb corresponding to the target folding position α into the nip N1 during double folding, and the pressing force decreases when the leading edge Sa of the fold portion emerges out of the nip N1. As a result of the variation in pressing force, variation also occurs in terms of load on the folding roller motor 137, which rotationally drives the first pair of folding rollers 8*a*. Variation in load on the folding roller motor 137 increases likelihood of variation occurring in terms of rotational speed of the folding roller motor 137.

Variation in rotational speed of the folding roller motor 137 causes variation, to a degree in accordance with magnitude of the variation in rotational speed, in terms of an amount of time until conveyance of the sheet bundle Sb by the first pair of folding rollers 8*a* is suspended. Consequently, variation occurs in terms of distance that the sheet bundle Sb has been conveyed at the time conveyance thereof is suspended.

Figure 16:
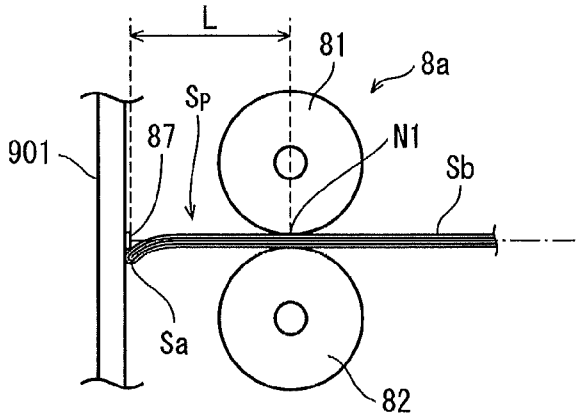
FIG. 16 illustrates configuration of a comparative example in which a heating member is fixed to a fixing member.

Suppose that in a situation in which variation in conveyance distance of the sheet bundle Sb inevitably occurs, a configuration is adopted in which, as illustrated for example in FIG. 16, the heating member 87 is fixed in place by a fixing member 901, and a distance along the conveyance path between the nip N1 of the first pair of folding rollers 8*a* and the heating member 87 is L. When conveyance distance of the sheet bundle Sb, up until suspension of conveyance, is a large value in the range of variation, length of a sheet portion Sp, which is a portion of the sheet bundle Sb located between the nip N1 of the first pair of folding rollers 8*a* and the heating member 87, is greater than the distance L.

When length of the sheet portion Sp is greater than the distance L, stiffness of the sheet portion Sp causes the sheet portion Sp to bend. As a result, the leading edge Sa of the sheet bundle Sb may be displaced from the heating member 87, and thus heating of the leading edge Sa may not be possible or may be insufficient.

Conversely, when conveyance distance of the sheet bundle Sb, up until conveyance is suspended, is a small value, the leading edge Sa of the sheet bundle Sb does not reach the heating member 87, and thus heating of the sheet bundle Sb is not possible.

On the other hand, suppose that a configuration is adopted in which the heating member 87 is supported such as to be freely moveable in the sheet conveyance direction, as in the present embodiment. In such a configuration, the heater 87 is able to move within the moveable range of the long opening 243 in each of the first heater supporting parts 204, against the force applied by the torsion spring 206, thus enabling unified movement of the heating member 87 and the sheet bundle Sb while the leading edge Sa is in contact with the heating member 87, regardless of variation in conveyance distance of the sheet bundle Sb up until conveyance thereof is suspended.

In other words, force applied by the torsion springs 206 is predetermined to be of a magnitude that while the leading edge Sa of the fold portion of the sheet bundle Sb in contact with the heating member 87, allows unified movement of the folded sheet bundle Sb and the heating member 87 in the sheet conveyance direction, against the force, until conveyance of the sheet bundle Sb is suspended through suspension of rotation of the first pair of folding rollers 8*a*. Through the above, contact can be maintained between the heating member 87 and the leading edge Sa of the fold portion of the sheet bundle Sb which is being conveyed.

Consequently, even if variation occurs in conveyance distance of the sheet bundle Sb up until conveyance thereof is suspended, the effect of such variation is absorbed, ensuring that the heating member 87 heats the leading edge Sa of the fold portion while in contact therewith.

It is possible to ensure that the effect of variation in conveyance distance of the sheet bundle Sb is absorbed by setting appropriate values for a moveable range P of the heating member 87 illustrated in FIG. 15A, which corresponds to length in the sheet conveyance direction of the long opening 243 in each of the first heater supporting parts 204, and for magnitude of the force applied by the torsion springs 206. The aforementioned values may be determined in advance through experimentation or the like, in accordance with an amount of variation that occurs in conveyance distance of the sheet bundle Sb. The moveable range P may for example have a length of approximately 5 mm.

Significance of the above is that the first heater supporting parts 204 and the torsion springs 206 function as a supporting unit which supports the heating member 87 in a manner such as to be freely moveable in the sheet conveyance direction (i.e., position of the heating member 87 in terms of the sheet conveyance direction is changeable), in accordance with an amount of conveyance (distance) of the sheet bundle Sb after folding thereof, such that the leading edge Sa of the fold portion of the sheet bundle Sb is in contact with the heating member 87 when conveyance of the sheet bundle Sb is suspended.

Figure 15C:
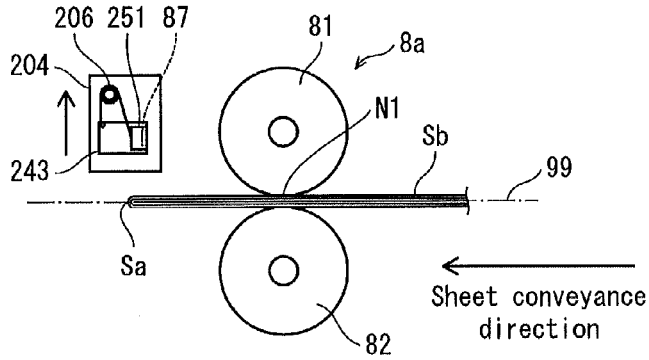
FIG. 15C is a schematic diagram illustrating heating of the sheet bundle by the heating member at time t3.

FIG. 15C illustrates a situation in which the heating member 87 is moved back to the standby position from the heating position once heating by the heating member 87 is complete (time t3).

Figure 15D:
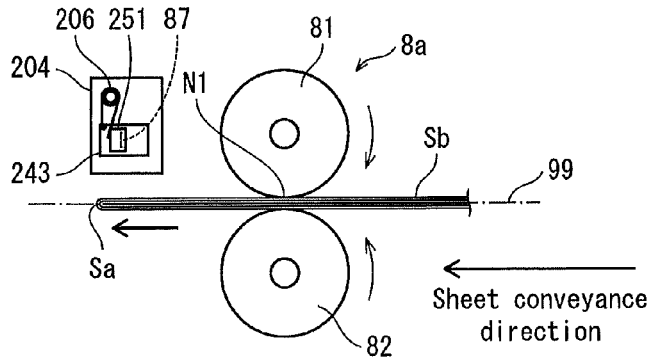
FIG. 15D is a schematic diagram illustrating heating of the sheet bundle by the heating member at time t4.

FIG. 15D illustrates a situation in which rotation of the first pair of folding rollers 8*a* recommences after the heating member 87 has moved back to the standby position (time t4). Recommencement of rotation of the first pair of folding rollers 8*a* causes recommencement of conveyance of the sheet bundle Sb after heating thereof.

The above completes the heating operation of the heating member 87, performed on the leading edge Sa of the fold portion of the sheet bundle Sb. In the above example heating is performed on the sheet bundle Sb, but heating operation can be performed in the same way on a single sheet S.

As explained above, when a jam occurs during conveyance of a sheet bundle Sb or a single sheet S after double folding thereof, a user is able to remove the jammed sheet bundle Sb or single sheet S through use of the openable cover 31. Note that in the above situation the heating member 87 is located at the standby position.

As illustrated in FIG. 10, when the heating member 87 is located at the standby position, the folding knife 201 is located downstream of the heating member 87 in terms of the sheet conveyance direction, and a leading edge of the blade 201*a*, in terms of movement direction of the folding knife 201, is located closer than the heating member 87 to the nip N2 of the second pair of folding rollers 8*b*.

As a result of the positional relationship described above, when the user inserts a hand into the after-processing device 2 in order to remove a sheet jam, the folding knife 201 located downstream of the heating member 87 functions like a wall, preventing the user's hand from touching the heating member 87.

Figure 17:
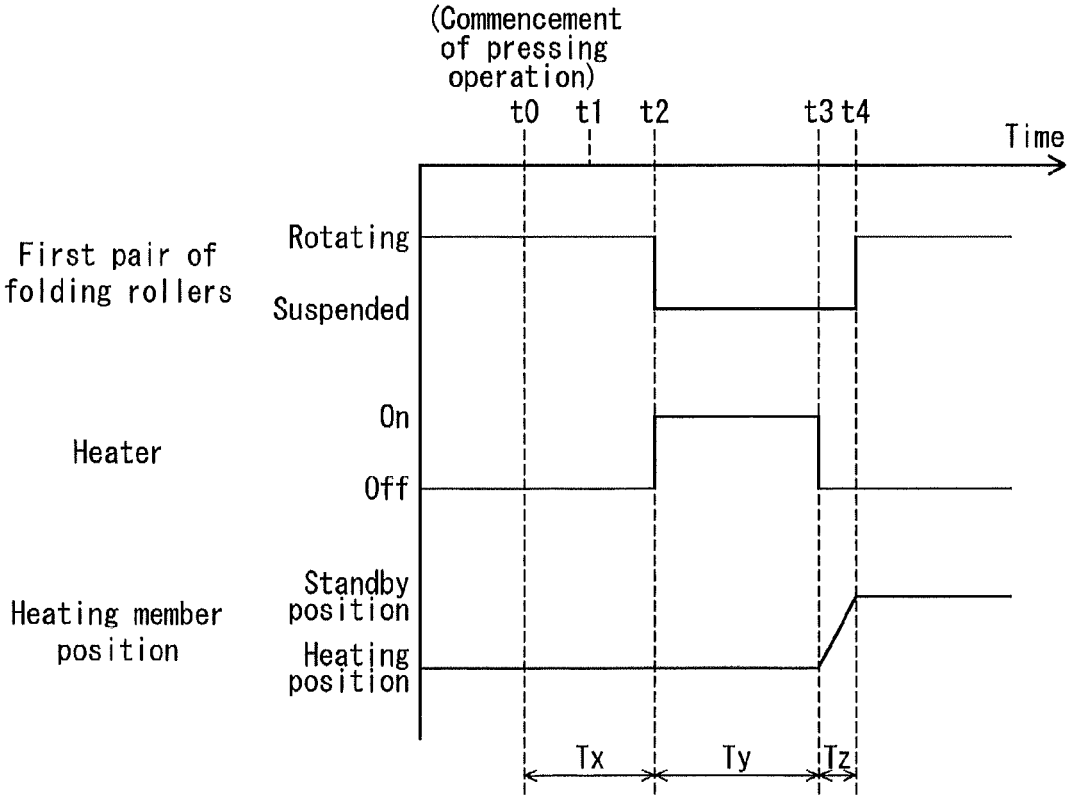
FIG. 17 illustrates a time chart of heating operation performed by the heating member.

FIG. 17 illustrates a time chart of heating operation by the heating member 87.

As illustrated in FIG. 17, at time t0 the first pair of folding rollers 8*a* (folding rollers 81 and 82) are rotating, the heater 871 of the heating member 87 is set to off (i.e., electricity is not supplied), the heating member 87 is located at the heating position, and the pushing operation of the first folding knife unit 85 commences, pushing the sheet bundle Sb into the nip N1 of the first pair of folding rollers 8*a*. The above corresponds to a state illustrated in FIG. 4.

In FIG. 17, time t1 directly after the pushing operation commences corresponds to time t1 illustrated in FIG. 15A. At time t1 the leading edge Sa of the fold portion of the sheet bundle Sb, which is being conveyed along the conveyance path 99 by the first pair of folding rollers 8*a*, has not yet reached the heating member 87.

In FIG. 17, time t2 at which a predetermined period of time Tx has passed since commencement of the pushing operation (time t0) corresponds to time t2 illustrated in FIG. 15B. At time t2 rotation of the first pair of folding rollers 8*a* is suspended and the heater 871 is set to on (i.e., electricity is supplied).

The predetermined period of time Tx is set as an amount of time required, from commencement of the pushing operation, until the leading edge Sa of the sheet bundle Sb conveyed by the first pair of folding rollers 8*a* is in contact with the heating member 87, and while in contact therewith the leading edge Sa has reached a reference position which is equivalent to a central point of the long opening 243 in the first heater supporting part 204, in terms of the sheet conveyance direction (FIG. 15B).

By setting the predetermined period of time Tx in consideration of a situation in which the leading edge Sa of the sheet bundle Sb is located at the reference position, and by setting the moveable range P of the heating member 87 (i.e., length of the long opening 243) at a magnitude sufficient to allow absorption of the effect of variation in conveyance distance of the sheet bundle Sb, it is possible to ensure that when conveyance of the sheet bundle Sb is suspended, the heating member 87 heats the leading edge Sa of the fold portion while in contact therewith, even when the conveyance distance is a maximum value or a minimum value in the range of variation.

In FIG. 17, time t3 at which a predetermined period of time Ty has passed since time t2 corresponds to time t3 illustrated in FIG. 15C, and the predetermined period of time Ty corresponds to heating time. At time t3, the heater 871 is set to off (i.e., supply of electricity is cut-off) and an operation commences of returning the heating member 87 from the heating position to the standby position.

In FIG. 17, time t4 at which a predetermined period of time Tz has passed since time t3 corresponds to time t4 illustrated in FIG. 15D. At time t4, rotation of the first pair of folding rollers 8*a* recommences. The predetermined period of time Tz is set such as to correspond to an amount of time required for the heating member 87 to move back to the standby position from the heating position.

(8) Operation of Folding Knife 201 During Triple Folding

Figure 18:
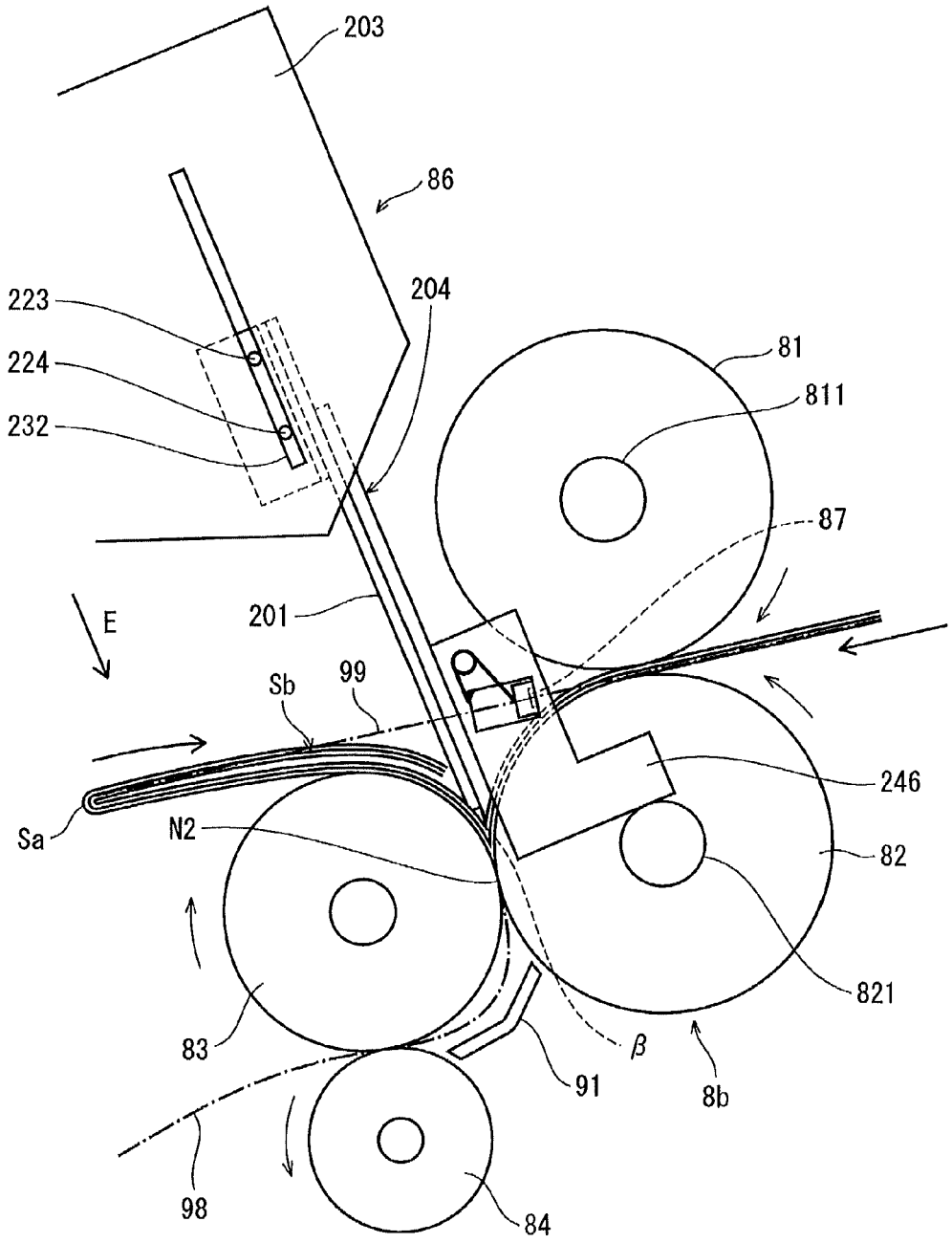
FIG. 18 illustrates operation of the second folding knife during triple folding.

FIG. 18 illustrates operation of the folding knife 201 during triple folding.

As illustrated in FIG. 18, during triple folding the folding knife 201 is lowered to a pressing position (third position) in order to press a portion of a sheet bundle Sb corresponding to the target folding position β, pushing the portion into the nip N2 of the second pair of folding rollers 8*b*. Note that the sheet bundle Sb has already been double folded and heated. The pressing position of the folding knife 201 is lower than the second position at which the folding knife 201 is located when the heating member 87 is held at the heating position (FIG. 14).

During lowering of the folding knife 201 from the first position (uppermost position) to the pressing position, a positional relationship is maintained of the leading edge of the blade 201*a* of the folding knife 201 (i.e., an edge that contacts with the sheet S) being closer than the heating member 87 to the nip N2 of the second pair of folding rollers 8*b*. The above ensures that the blade 201*a* of the folding knife 201 comes into contact with the sheet bundle Sb and that the heating member 87 does not come into contact with the sheet bundle Sb.

If hypothetically the heating member 87 were to come into contact with the sheet bundle Sb before the folding knife 201 during the pressing operation of the folding knife 201 on the sheet bundle Sb, position of the sheet bundle Sb in terms of the sheet conveyance direction might be shifted, causing folding of the sheet bundle Sb at a position deviating from the target folding position β. Therefore, the configuration described above prevents deviation of folding position from the target folding position β.

Furthermore, during lowering of the folding knife 201 to the pressing position, the bottom edge of the extended section 246 of each of the first heater supporting parts 204 comes into contact with the rotational axle 821 of the folding roller 82, in the same way as when located at the heating position, restricting further lowering of the heating member 87. Therefore, the heating member 87 does not move lower than the conveyance path 99, thus preventing the heating member 87 from coming into contact with the sheet bundle Sb during triple folding.

Once the sheet bundle Sb has passed through the nip N2 of the second pair of folding rollers 8*b*, the sheet bundle Sb is conveyed to the conveyance roller 84 along the conveyance path 98 through the guide 91, with the target folding position β as a leading edge thereof. The sheet bundle Sb is subsequently conveyed further downstream by the conveyance roller 84 and the folding roller 83.

(9) Processing for Heating Operation During Double Folding

Figure 19:
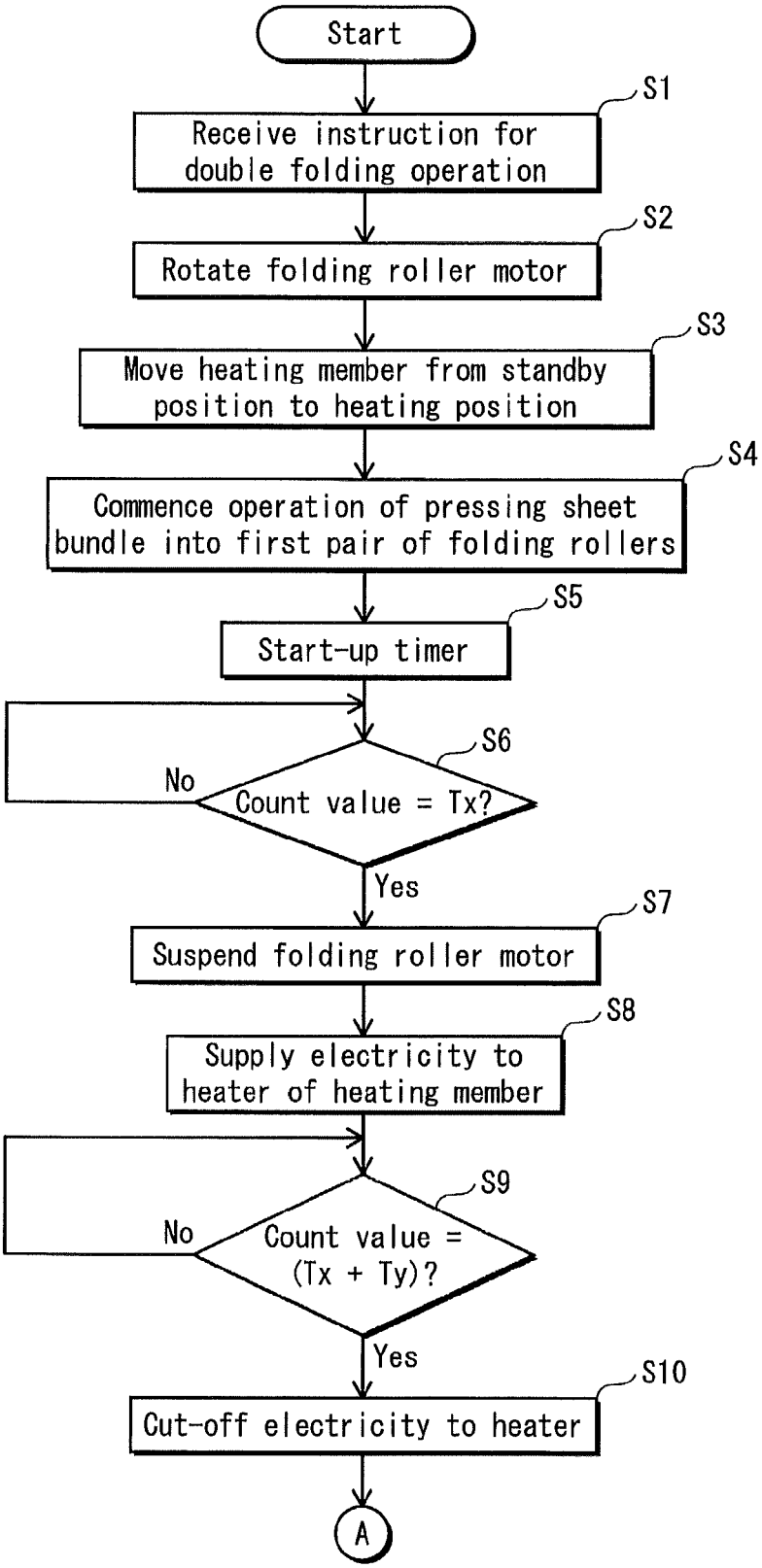
FIG. 19 is a flowchart illustrating one part of processing for heating of a sheet bundle during double folding.
Figure 20:
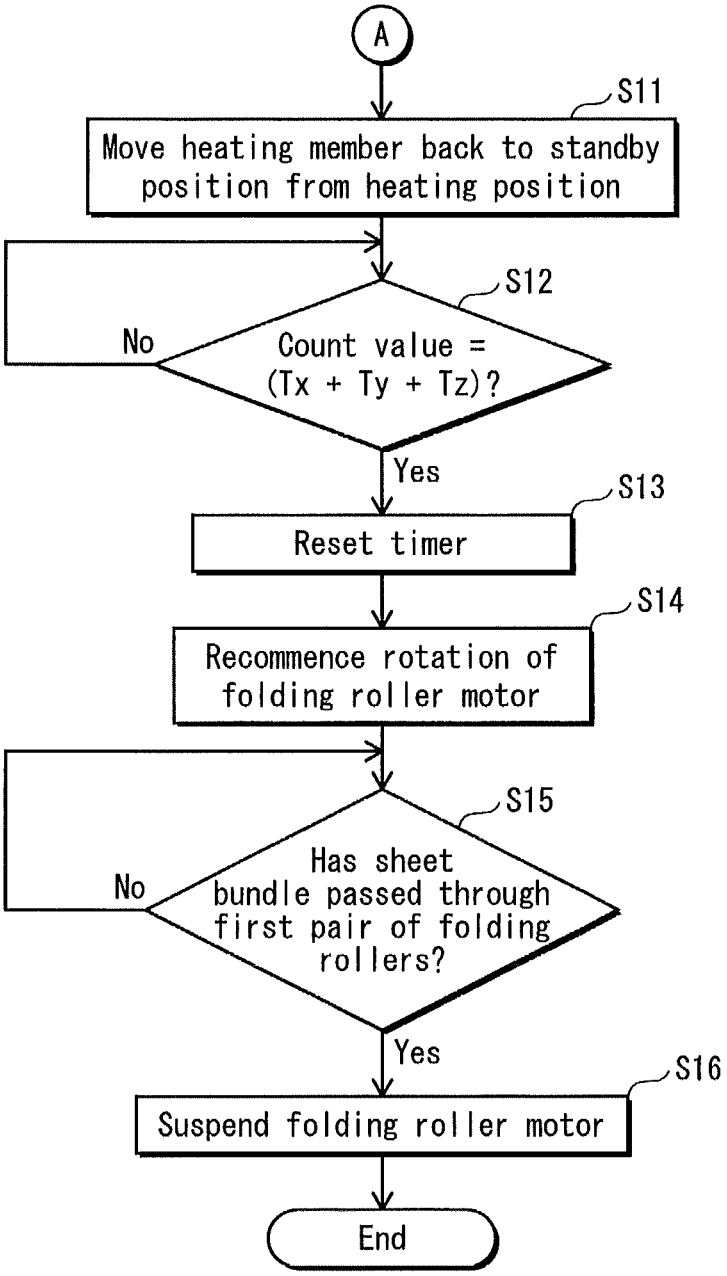
FIG. 20 is a flowchart illustrating a remaining part of the processing for heating of a sheet bundle during double folding.

FIGS. 19 and 20 illustrate a flowchart of processing for heating operation performed on a sheet bundle during double folding. The processing is executed by the central processor 101 of the controller 30 for each performance of the heating operation. Note that during triple folding, processing for heating operation illustrated in FIGS. 19 and 20 is executed for a first fold of the sheet bundle Sb, and subsequently a second fold operation is performed on the sheet bundle Sb which has been heated.

As illustrated in FIG. 19, when an execution instruction for double folding is received from the image formation device 1 (Step S1), the folding roller motor 137 commences rotational driving (Step S2), causing rotation of rollers such as the folding rollers 81-83.

Next, the heating member 87 is moved from the standby position to the heating position (Step S3). The aforementioned movement of the heating member 87 is performed through driving of the second knife motor 134.

When n sheets S (n is a positive integer) which are to be double folded have all been stacked in the sheet stacker 27, pressing operation of the folding knife 85*a* commences, pressing the target folding position α of a sheet bundle Sb formed by the sheets S into the nip N1 of the first pair of folding rollers 8*a* (Step S4; time t0 in FIG. 17). Through the above, double folding of the sheet bundle Sb commences.

The value of n, indicating the number of sheets S, is acquired from the image formation device 1. A sheet detecting sensor (not illustrated) detects when each sheet S is conveyed to the sheet stacker 27, enabling detection that n sheets S have been stacked in the sheet stacker 27 based on a number of detections by the sheet detecting sensor.

Next, the timer 102 is started-up (Step S5), and a judgment is performed as to whether a count value of the timer 102 is equal to the predetermined period of time Tx (Step S6).

When the count value of the timer 102 is judged to be equal to the predetermined period of time Tx (Step S6: Yes; time t2 in FIG. 17), rotation of the folding roller motor 137 is suspended (Step S7), and electricity is supplied to the heater 871 of the heating member 87 (Step S8).

Through the above, conveyance of the sheet bundle Sb by the first pair of folding rollers 8*a* after double folding is suspended, and the heating member 87 heats a leading edge Sa of a fold portion of the sheet bundle Sb while in contact therewith (FIG. 15B). Significance of the above is that the controller 30 functions as a movement suspending member that suspends rotation of the first pair of folding rollers 8*a* during execution of processing in Step S7, in order to suspend conveyance of the sheet bundle Sb after double folding thereof.

Next, a judgment is performed as to whether count value of the timer 102 is equal to a predetermined period of time (Tx+Ty) (Step S9).

When the count value of the timer 102 is judged to be equal to the predetermined period of time (Tx+Ty) (Step S9: Yes; time t3 in FIG. 17), supply of electricity to the heater 871 of the heating member 87 is cut-off (Step S10). The above completes heating of the leading edge Sa of the fold portion of the sheet bundle Sb.

As illustrated in FIG. 20, next an operation commences of moving the heating member 87 back to the standby position from the heating position (Step S11; FIG. 15C), thus returning the heating member 87 to the standby position.

Next, a judgment is performed as to whether count value of the timer 102 is equal to a predetermined period of time (Tx+Ty+Tz) (Step S12).

When the count value of the timer 102 is judged to be equal to the predetermined period of time (Tx+Ty+Tz) (Step S12: Yes; time t4 in FIG. 17), the timer 102 is reset to zero (Step S13), and rotation of the folding roller motor 137 is recommenced (Step S14), thus recommencing conveyance of the sheet bundle Sb (FIG. 15D).

When the sheet bundle Sb has been judged to have completely passed through the first pair of folding rollers 8*a* after heating (Step S15: Yes), rotation of the folding roller motor 137 is suspended (Step S16), completing the present processing. Note that judgment as to whether the sheet bundle Sb has completely passed through the first pair of folding rollers 8*a* is performed in accordance with whether a sheet ejection sensor (not illustrated) located along the conveyance path 99 has detected a trailing edge, in terms of the sheet conveyance direction, of the sheet bundle Sb.

Also note that although explanation is given above for an example of configuration in which the heater 871 of the heating member 87 is switched on after rotation of the folding roller motor 137 is suspended (Steps S7 and S8), timing at which the heater 871 is set to on is not limited to being after rotation of the folding roller motor 137 is suspended.

Alternatively, the heater 871 may be set to on a certain amount of time in advance, wherein the amount of time corresponds to time required for temperature of the heater 871 to reach a certain temperature required for heating of the leading edge of the fold portion of the sheet bundle Sb. In such a situation, the heater 871 is set to on before rotation of the folding roller motor 137 is suspended.

Timing at which the heater 871 is set to on can be determined based on heating properties of the heater 871. For example, the heater 871 can alternatively be set to on at the same time as a first sheet S is stacked in the sheet stacker 27, or at the same time as pressing operation of the folding knife 85*a* commences.

As explained above, the present embodiment has a configuration such that when conveyance of the sheet bundle Sb is suspended, the torsion springs 206 apply a force on the heating member 87 in the opposite direction to the sheet conveyance direction, causing contact between the heating member 87 and the leading edge Sa of the sheet bundle Sb to be maintained. Consequently, even when variation occurs in terms of conveyance distance of the sheet bundle Sb up until conveyance thereof is suspended, the effect of such variation is absorbed, enabling localized heating of the leading edge Sa of the sheet bundle Sb.

The fold portion of the sheet bundle Sb has a linear shape in terms of the sheet width direction. Therefore, by configuring the heater 871 and the substrate 872 of the heating member 87, each having an elongated shape, such as to match the linear shape of the fold portion of the sheet bundle Sb, width of the heater 871 and the substrate 872 (i.e., length of a dimension in the sheet thickness direction) can be reduced.

Through the above, the heater 871 can be reduced in size, reducing electricity consumption, and rate of temperature increase of the heater 871 can be increased through reduction in heat capacity of the heating member 87. Increasing rate of temperature increase of the heater 871 allows heating of the sheet bundle Sb to commence more quickly, shortening a period of time required between commencement and completion of heating.

The present embodiment has a configuration in which positions of the heating member 87 and the folding knife 201 can both be switched by driving force from a single driver (second knife motor 134). Therefore, device configuration can be made cheaper and simplified compared to a configuration in which two separate drivers are included.

Also, the present embodiment has a configuration in which the heating member 87 moves in parallel to the folding knife 201, which moves in a direction intersecting the sheet conveyance direction. Therefore, the heating member 87 can be located close to the folding knife 201 in terms of the sheet conveyance direction, allowing reduction in size, in terms of the sheet conveyance direction, of a movement mechanism for the folding knife 201 and the heating member 87.

Through the above, the movement mechanism of the folding knife 201 and the heating member 87 can be contained without requirement to provide a large amount of space around the folding knife 201. Consequently, it is possible to prevent increase in size of the after-processing device 2 being required in order to ensure sufficient containment space.

The present invention is not limited to an after-processing device, and can alternatively be practiced as a method for heating a fold portion of a sheet. Also, the aforementioned method can be a program executed by a computer. Furthermore, the aforementioned program relating to the present invention can be recorded on any type of computer-readable recording medium, which can for example be a magnetic disk, such as a magnetic tape or a flexible disk, or an optical recording medium, such as a DVD-ROM, DVD-RAM, CD-ROM, CD-R, MO or PD. The program relating to the present invention can be produced and distributed as the recording medium, or can be distributed by transferring the program through broadcasting, electrical communication lines, satellite communications, a wired or wireless network such as the Internet, or the like.

Modified Examples

The present invention is explained based on the above embodiment, but the present invention is of course not limited to the embodiment, and modified examples such as described below are also considered.

(1) In the above embodiment an example of configuration is explained in which contact between the heating member 87 and the leading edge Sa of the fold portion of the sheet bundle Sb is maintained through the force applied by the torsion springs 206, but the present invention is not limited to such a configuration. For example, alternatively a configuration may be adopted which uses magnetic force of a magnet.

Figure 21:
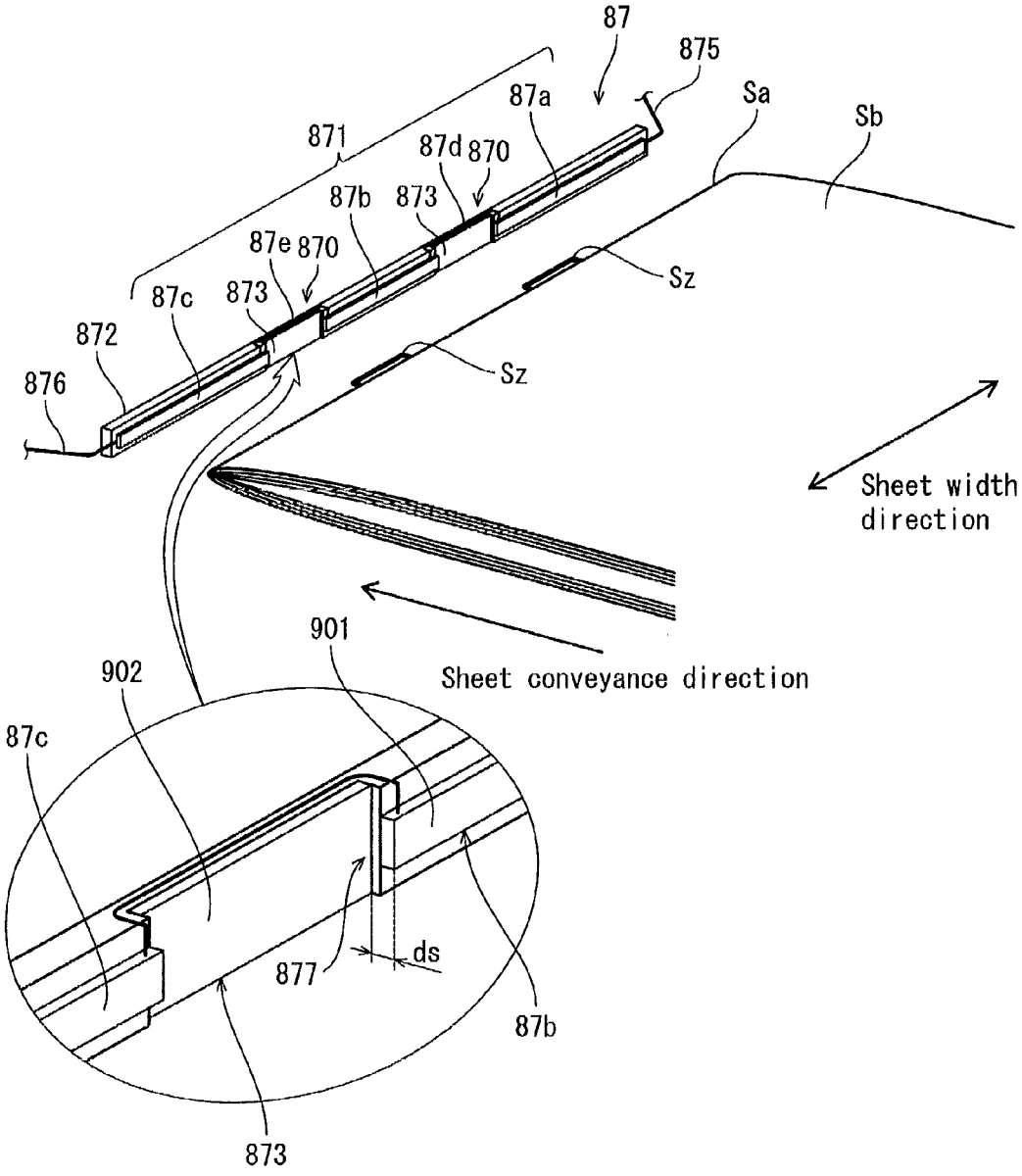
FIG. 21 illustrates a configuration relating to a modified example which uses magnetic force of a magnet.

FIG. 21 illustrates an example of a configuration in which magnetic force of a magnet is used in addition to the force applied by the torsion springs 206, in order to maintain contact between the heating member 87 and the leading edge Sa of the fold portion of the sheet bundle Sb. Note that the second heater supporting parts 205, supporting opposite ends of the heating member 87 in terms of the sheet width direction, the torsion springs 206, and the like are disposed in the same way as in the embodiment, and are therefore are omitted in FIG. 21.

As illustrated in FIG. 21, the heating member 87 includes the heater 871, the substrate 872, and two magnets 873.

The heater 871 is composed of three heaters 87*a*, 87*b* and 87*c*, each having an elongated shape in the sheet width direction. The heaters 87*a*-87*c* are attached to an upstream surface of the substrate 872, in terms of the sheet conveyance direction, with intervals therebetween in terms of the sheet width direction.

The heaters 87*a*-87*c* are connected to one another in series through leads 87*d* and 87*e*, which are covered by an insulating material. The heaters 87*a*, 87*b* and 87*c* are connected to the driver 129 (FIG. 9) through a lead 875 connected to the heater 87*a* and a lead 876 connected to the heater 87*c*.

The substrate 872 has an elongated shape in the sheet width direction. The upstream surface of the substrate 872 has two recesses 870 respectively located in a section between the heaters 87*a* and 87*b*, and a section between the heaters 87*b* and 87*c*.

The magnets 873 each have an elongated plate shape in the sheet width direction, and are attached to the substrate 872 in a manner such as to fit into the recesses 870 in one-to-one correspondence.

Positions of the magnets 873 (positions of the recesses 870 in the sheet width direction) are determined in advance such that when the sheet bundle Sb is bound by insertion of staples Sz by the stapler 26, and the sheet bundle Sb is subsequently double folded at the same position as the binding, the positions of the magnets 873 correspond in terms of the sheet width direction to the positions at which the staples Sz are inserted by the stapler 26 during the binding of the sheet bundle Sb. Note that the staples Sz are made of a material which is attracted toward the magnets 873 by magnetic force of the magnets 873. In the present example the staples Sz are made of iron.

The heaters 87*a*-87*c* and the magnets 873 are attached to the substrate 872 in a stepped configuration such that steps 877 are present between upstream surfaces 901 (first surfaces) of the heaters 87*a*-87*c*, in terms of the sheet conveyance direction, and upstream surfaces 902 (second surfaces) of the magnets 873, in terms of the sheet conveyance direction. Through the stepped configuration, the upstream surfaces 902 of the magnets 873 are located a predetermined distance ds downstream in the sheet conveyance direction relative to the upstream surfaces 901 of the heaters 87*a*-87*c*. In the present example the predetermined distance ds is 0.5 mm. The predetermined distance ds is equivalent to diameter of each of the staples Sz. Thickness of the heaters 87*a*-87*c* and the magnets 873 is predetermined in order to form the steps 877 of the predetermined distance ds.

Through a configuration such as described above, once the sheet bundle Sb has been bound by two staples Sz at positions having a predetermined interval therebetween in terms of the sheet width direction, and once the sheet bundle has subsequently been double folded, when the sheet bundle Sb is conveyed downstream with the fold portion as a leading edge Sa thereof, the leading edge Sa of the fold portion comes into contact with the heaters 87*a*-87*c*. Also, the staples Sz protruding out from the leading edge Sa of the fold portion each fit into a space formed due to the steps 877 between a corresponding one of the magnets 873 located opposite the staple Sz and heaters located adjacently to the magnet 873. The staple Sz is attracted toward the magnet 873 due to the magnetic force of the magnet 873.

When the conveyance of the sheet bundle Sb is suspended, contact between the heaters 87*a*-87*c* and the leading edge Sa of the fold portion of the sheet bundle Sb is maintained through force applied by the torsion springs 206 (not illustrated in FIG. 21), in the same way as in the embodiment. The magnetic force of the magnets 873, which attracts the staples Sz, provides supplementary assistance in maintaining the aforementioned contact.

Imagine a situation in which, for example, during a heating operation on the sheet bundle Sb, a next sheet S on which after-processing such as stapling is to be performed is conveyed to the after-processing device 2. Even if vibrations occurring in the after-processing device 2 during conveyance of the sheet S were to be transmitted to the sheet bundle Sb which is being heated, the sheet bundle Sb is attracted toward the heating member 87 due to the supplementary effect of the magnetic force of the magnets 873, reducing possibility of the leading edge Sa of the sheet bundle Sb becoming displaced from the heaters 87*a*-87*c*. Therefore, the configuration described above enables greater stabilization during heating.

Note that while an example of configuration is explained above in which the two magnets 873 are included, the number of magnets is not limited to two. One magnet or a plurality of magnets may each be provided at a position corresponding to a position at which a sheet bundle Sb is bound by a staple Sz.

Also note that while the predetermined distance ds is 0.5 mm in the above explanation, the predetermined distance ds is not limited to being 0.5 mm. For example, if diameter of the staple Sz is dt, the predetermined distance ds may be set in a range of values satisfying $0<ds\leq dt$. Alternatively, the steps 877 may be omitted (i.e., ds=0), such that surfaces of the heaters 87*a*-87*c* and the magnets 873 are coplanar.

Furthermore, in a situation in which only sheet bundles which have been stapled are targets for heating, if it is possible to maintain contact between the heater and the leading edge Sa of the fold portion of the sheet bundle Sb through only the magnetic force of the magnets 873, inclusion of the torsion springs 206 is not essential.

Figure 22:
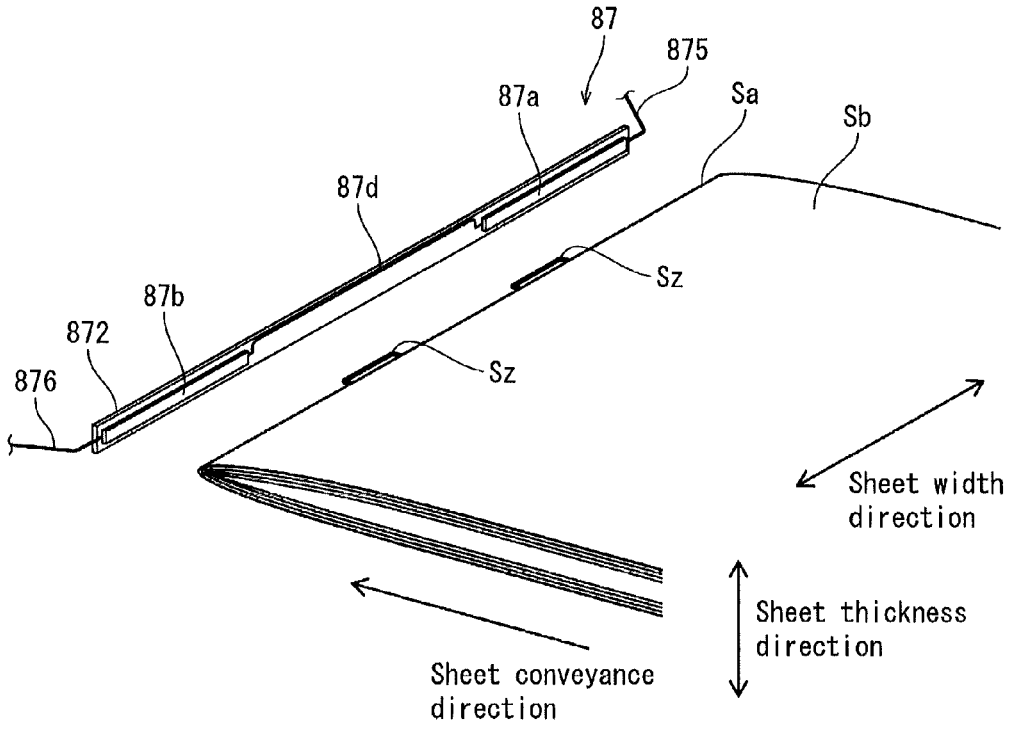
FIG. 22 illustrates a configuration relating to a modified example in which two heaters are arranged with an interval therebetween in a sheet width direction.

(2) In the embodiment, an example of configuration is explained which includes the one heater 871, having an elongated shape in the sheet width direction, but the present invention is not limited to such a configuration. For example, alternatively a configuration may be adopted such as illustrated in FIG. 22, including two heaters 87*a* and 87*b* which each have a relatively short elongated shape in the sheet width direction, and which are positioned with an interval therebetween in the sheet width direction.

In the above configuration, the leading edge Sa of the fold portion of the sheet bundle Sb is only heated at opposite end portions thereof in terms of the sheet width direction. A central portion of the leading edge Sa in terms of the sheet width direction is not heated in the above configuration. However, by suppressing bulging of the aforementioned end portions which are free ends of the sheet bundle Sb, force causing bulging of the central portion can be suppressed from both ends thereof, and consequently bulging of the sheet bundle Sb can still be prevented to a certain extent.

The number of heaters is not limited to two, and may alternatively be more than two.

Figure 23:
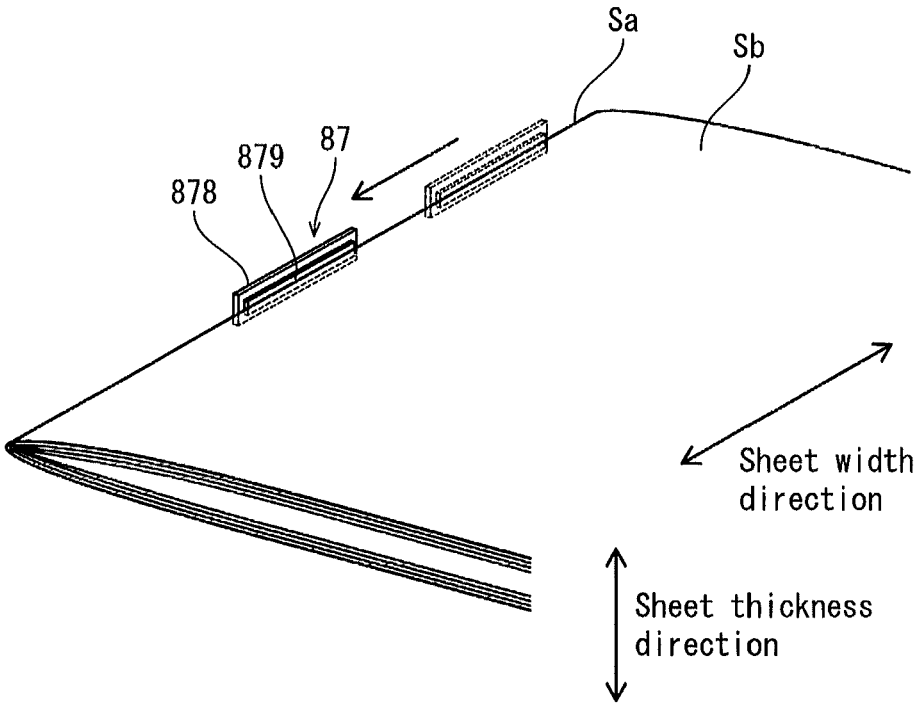
FIG. 23 illustrates a configuration relating to a modified example in which a heating member is moveable in a sheet width direction.

Further alternatively, a configuration such as illustrated in FIG. 23 may be adopted in which the heating member 87 is movable along the sheet width direction.

As illustrated in FIG. 23, the heating member 87 includes a substrate 878 and a heater 879 mounted thereon. The heater 879 has a relatively short elongated shape.

While in a state in which the leading edge Sa of the fold portion of the sheet bundle Sb in contact with the heater 879 of the heating member 87, control is performed in order to supply electricity to the heater 879 and also in order to move the heating member 87 along the sheet width direction from one end of the leading edge Sa in terms of the sheet width direction, to an opposite end of the leading edge Sa in terms of the sheet width direction. Through the above, the leading edge Sa of the fold portion of the sheet bundle Sb is heated along an entire sheet width thereof.

When a configuration is adopted in which the heating member 87 is moved along the sheet width direction, such as described above, use of the heater 879, which has a relatively short elongated shape in the sheet width direction, is possible.

The heater 879 has a relatively small size resulting in further reduction in heat capacity of the heating member 87, and thus enabling further reduction in electrical power consumption.

Note that illustration of a movement mechanism for the heating member 87 is omitted in FIG. 23. The movement mechanism may for example include a supporting part which supports the heating member 87 in a manner such as to be freely slidable along the sheet width direction, and a drive part, such as a direct drive motor, which imparts driving force on the heating member 87 in the sheet width direction. The drive part is controlled such that the heating member 87 is moved at a predetermined speed which is suitable for heating the sheet bundle Sb.

The drive part may for example be a drive mechanism in which a belt stretched between two or more pulleys is rotationally driven, and in which driving force of the belt is transmitted to the heating member 87.

(3) In the embodiment, an example of configuration is explained in which the heating member 87 is supported by the folding knife 201 in a manner such as to be freely moveable in the sheet thickness direction, and positions of the folding knife 201 and the heating member 87 can be changed through a single driver, but the present invention is not limited to such a configuration. In an alternative configuration, a movement mechanism and driver may be provided separately for both the folding knife 201 and the heating member 87.

In the alternative configuration described above, positional relationship of the folding knife 201 and the heating member 87 in terms of the sheet conveyance direction can be reversed compared to the embodiment. In other words, the heating member 87 can be positioned downstream of the folding knife 201 in terms of the sheet conveyance direction. Note that in terms of preventing increase in device size, preferably movement direction of the folding knife 201 and movement direction of the heating member 87 should be parallel to one another in the same way as in the embodiment, but it is not essential that the aforementioned movement directions are parallel.

(4) In the embodiment, an example of configuration is explained in which the torsion springs 206 are used as a biasing part that applies a force on the heating member 87 in the opposite direction to the sheet conveyance direction, but the present invention is not limited to such a configuration. A different type of spring or a part other than a spring, such as an elastic body, may alternatively be used as the biasing part, so long as the biasing part is able to apply a force on the heating member 87 in the opposite direction to the sheet conveyance direction.

Further alternatively, instead of a spring or the like, a configuration such as a motor which moves the heating member 87 by applying driving force can be used.

More specifically, until conveyance of the sheet bundle Sb is suspended, the heating member 87 may be held at a standby position located downstream in terms of the sheet conveyance direction, such as to not interfere with conveyance of the sheet bundle Sb. When conveyance of the sheet bundle Sb is suspended after folding thereof, the heating member 87 is moved in the opposite direction to the sheet conveyance direction to the heating position, at which the heating member 87 is in contact with the leading edge Sa of the fold portion. Once the heating member 87 is in contact with the leading edge Sa of the sheet bundle Sb, movement of the heating member 87 is suspended and heating is performed. Once heating is complete, the heating member 87 is moved back to the original standby position. Movement of the heating member 87 to the heating position and movement to return the heating member 87 to the standby position can be performed through driving force from a motor or the like.

When variation occurs in terms of amount of conveyance (distance) up until conveyance of the sheet bundle Sb is suspended, an amount of movement of the heating member 87 in the opposite direction to the sheet conveyance direction also changes. Therefore, the configuration in the present modified example is also a configuration in which the heating member 87 is supported such as to be moveable in the sheet conveyance direction in accordance with the amount of conveyance imparted on the sheet bundle Sb up until conveyance thereof is suspended. Consequently, the configuration in the present modified example also ensures that the heating member 87 heats the leading edge Sa of the fold portion of the sheet bundle Sb while in contact therewith.

In the configuration described in the present modified example, control is required for amount of movement of the heating member 87 in order that the heating member 87 is in contact with the leading edge Sa of the sheet bundle Sb, even if variation occurs in terms of distance the sheet bundle Sb is conveyed up until conveyance thereof is suspended. In one example of a method for determining amount of movement of the heating member 87, a distance sensor or the like can be used to detect distance between the standby position of the heating member 87 and the leading edge Sa of the fold portion of the sheet bundle Sb, once conveyance of the sheet bundle Sb has been suspended. The amount of movement of the heating member 87 can be determined in accordance with the distance which is detected.

(5) In the embodiment an example of configuration is explained in which double folding and triple folding can be switched between selectively, and in which the leading edge Sa of the fold portion of the sheet bundle Sb is heated after double folding, but the present invention is not limited to such a configuration. For example, in an alternative configuration heating may also be performed after triple folding on a leading edge of a fold portion (portion corresponding to the target folding position β) of a sheet bundle. The above can be implemented through a configuration in which an additional heating member, separate to the heating member 87, is located downstream of the nip N2 of the second pair of folding rollers 8*b* in terms of sheet conveyance direction after triple folding, and in which the additional heating member is moveable in the sheet conveyance direction in the same way as the heating member 87.

(6) If the after-processing device 2 has a configuration in which only double folding can be implemented, a mechanism may be provided for moving the heating member 87 between the heating position on the conveyance path 99 and the standby position separated from the conveyance path 99. In the situation described above, preferably the heating position should be downstream, in terms of the sheet conveyance direction, of the nip N1 of the first pair of folding rollers 8*a* in the same way as in the embodiment, and should preferably be located as close as possible to the nip N1. The following explains reasoning behind the positioning described above.

The closer the heating position is to the nip N1, the shorter conveyance distance is after double folding in order to convey the sheet bundle Sb to the heating member 87. Longer conveyance distance for the sheet bundle Sb typically results in greater variation in conveyance distance up until conveyance is suspended. Therefore, shortening conveyance distance enables conveyance of the sheet bundle Sb to be suspended while only a relatively small amount of variation has occurred.

By reducing amount of variation occurring in conveyance distance of the sheet bundle up until suspension of conveyance, the moveable range P (FIG. 15A) of the heating member 87 in the sheet conveyance direction can be made shorter. Shortening of the moveable range P enables reduction in size of a movement mechanism provided in the first heater supporting parts 204 for heating member 87.

If for example only a small amount of space is available in the after-processing device 2, reducing size of the movement mechanism for the heating member 87 may enable the movement mechanism to be included within the after-processing device 2.

(7) In the embodiment an example of configuration is explained that uses a mechanism in which the folding roller 82 presses against the folding roller 81, but the present invention is not limited to such a configuration. For example, in an alternative configuration a biasing member such as a spring may be provided for each of the folding rollers 81 and 82, causing the folding rollers 81 and 82 to press against one another. The above explanation also applies to the folding rollers 82 and 83.

In the embodiment an example is explained in which the image formation device 1 and the after-processing device 2 are configured as separate devices, but the present invention is not limited to such a configuration. For example, in an alternative configuration the image formation device 1 may be an image formation apparatus that includes the after-processing device 2 therein.

Furthermore, so long as the heating member 87 is a configuration element that is located downstream of the first pair of folding rollers 8*a* in terms of the sheet conveyance direction and that heats a leading edge of a fold portion of a sheet, the heating member 87 is not limited to the configuration described above. Also, dimensions of the heating member 87 and the moveable range P are not limited to values described above, and can be determined as appropriate values in accordance with device configuration.

Alternatively, contents described above in the embodiment and the modified examples may be combined.

SUMMARY

Contents of the embodiment and the modified examples illustrate one aspect for solving the problem explained above in the Description of the Related Art. The following summarizes contents of the embodiment and the modified examples.

In other words, one aspect of the present invention is an after-processing device for performing sheet folding, comprising: a pair of folding rollers configured to fold a sheet; a heating member located downstream of the pair of folding rollers in terms of a sheet conveyance direction; and a supporting unit that supports the heating member in a manner such that position of the heating member in terms of the sheet conveyance direction is changeable in accordance with an amount of conveyance imparted on the sheet by the pair of folding rollers after folding, wherein the position of the heating member in terms of the sheet conveyance direction changes such that the heating member is in contact with a leading edge of a fold portion of the sheet.

Alternatively, the after-processing device may further comprise a movement suspending member configured to suspend rotation of the pair of folding rollers after folding of the sheet, wherein the supporting unit may include: a supporting part that supports the heating member in a manner such as to be freely moveable in the sheet conveyance direction; and a biasing part that applies a force against the heating member in an opposite direction to the sheet conveyance direction, and the force may be of a magnitude that, while the leading edge of the sheet is in contact with the heating member, allows unified movement of the heating member and the sheet in the sheet conveyance direction until conveyance of the sheet is suspended through suspension of rotation of the pair of folding rollers.

Alternatively, the supporting unit may further include a switching part that causes switching of the heating member between a heating position located along a sheet conveyance path and a standby position separated from the sheet conveyance path, by moving the supporting part of the supporting unit.

Alternatively, one folding roller among the pair of folding rollers may be a first roller and another folding roller among the pair of folding rollers may be a second roller, the after-processing device may further comprise: a third roller that is in contact with the second roller; and a pressing member configured to perform an additional folding operation on the sheet by pressing a portion of the sheet, which has been folded by the pair of folding rollers, into a region in which the second roller is in contact with the third roller, the portion of the sheet pressed by the pressing member differing from the fold portion, wherein a movement direction of the supporting part of the supporting unit may be parallel to a pressing direction of the pressing member.

Alternatively, the supporting part may be supported by the pressing member in a manner such as to be freely moveable in the pressing direction, and the supporting unit may further include: a supporting part biaser that applies a force on the supporting part in the same direction as the pressing direction; and a position determining part that when the supporting part moves toward a first position from a second position due to pressing operation of the pressing member, determines position of the heating member in a sheet thickness direction by engaging with the supporting part and halting movement of the supporting part against the force applied by the supporting part biaser.

Alternatively, the position determining part may be a rotational axle of the second roller.

Alternatively, the pressing member may be located downstream of the heating member in terms of the sheet conveyance direction.

Alternatively, a leading edge at an end of the pressing member that contacts with the sheet may be located closer than the heating member to the region in which the second roller is in contact with the third roller.

Alternatively, the after-processing device may further comprise a movement suspending member configured to suspend rotation of the pair of folding rollers after folding of the sheet, wherein when conveyance of the sheet is suspended through suspension of rotation of the pair of folding rollers after folding, the supporting unit may move the heating member, which is located downstream of the sheet in terms of the conveyance direction, in an opposite direction to the conveyance direction, and may suspend movement of the heating member once the heating member is in contact with the leading edge of the fold portion of the sheet, and once heating by the heating member is complete, the supporting unit may move the heating member back to an original position thereof.

Alternatively, the after-processing device may further comprise a stapler, wherein the sheet may be provided in plurality as a sheet bundle, the stapler may bind the sheet bundle, prior to folding of the sheet bundle by the pair of folding rollers, by inserting a staple at a target folding position of the sheet bundle, the heating member may include a heater and a magnet, the staple may be formed from a material which is attracted by magnetic force of the magnet, the heater may heat the leading edge of the fold portion of the sheet bundle, and the magnet of the heating member may be located at a position corresponding in terms of a sheet width direction to a position at which the sheet bundle is bound by the stapler.

Alternatively, a first surface which is an upstream surface of the heater in terms of the sheet conveyance direction and a second surface which is an upstream surface of the magnet in terms of the sheet conveyance direction may have a stepped configuration such that the second surface is located downstream of the first surface in terms of the sheet conveyance direction, and when the leading edge of the fold portion of the sheet bundle is in contact with the first surface of the heater, the staple which protrudes out from the leading edge may fit into a space formed by the stepped configuration.

In another aspect of the present invention, an image formation apparatus comprises: an image formation device configured to form an image on a sheet; and an after-processing device configured to perform after-processing on the sheet on which the image has been formed, wherein the after-processing device includes: a pair of folding rollers configured to fold the sheet; a heating member located downstream of the pair of folding rollers in terms of a sheet conveyance direction; and a supporting unit that supports the heating member in a manner such that position of the heating member in terms of the sheet conveyance direction is changeable in accordance with an amount of conveyance imparted on the sheet by the pair of folding rollers after folding, and the position of the heating member in terms of the sheet conveyance direction changes such that the heating member is in contact with a leading edge of a fold portion of the sheet.

Alternatively, the after-processing device may further include a movement suspending member configured to suspend rotation of the pair of folding rollers after folding of the sheet, the supporting unit may include: a supporting part that supports the heating member in a manner such as to be freely moveable in the sheet conveyance direction; and a biasing part that applies a force against the heating member in an opposite direction to the sheet conveyance direction, and the force may be of a magnitude that, while the leading edge of the sheet is in contact with the heating member, allows unified movement of the heating member and the sheet in the sheet conveyance direction until conveyance of the sheet is suspended through suspension of rotation of the pair of folding rollers.

Alternatively, the after-processing device may further include a stapler, the sheet may be provided in plurality as a sheet bundle, the stapler may bind the sheet bundle, prior to folding of the sheet bundle by the pair of folding rollers, by inserting a staple at a target folding position of the sheet bundle, the heating member may include a heater and a magnet, the staple may be formed from a material which is attracted by magnetic force of the magnet, the heater may heat the leading edge of the fold portion of the sheet bundle, and the magnet of the heating member may be located at a position corresponding in terms of a sheet width direction to a position at which the sheet bundle is bound by the stapler.

Through the configuration described above, position of the heating member in terms of the sheet conveyance direction can be changed such that the leading edge of fold portion of the sheet is in contact with the heating member, even if variation occurs in terms of amount of conveyance imparted on the sheet by the pair of folding rollers after folding. Therefore, the configuration described above ensures that the leading edge of the fold portion is in contact with the heating member while the heating member is heating the leading edge.

Although the present invention has been fully described by way of examples with reference to the accompanying drawings, it is to be noted that various changes and modifications will be apparent to those skilled in the art. Therefore, unless such changes and modifications depart from the scope of the present invention, they should be construed as being included therein.

What is claimed is:

1. An after-processing device for performing sheet folding, comprising:

a pair of folding rollers configured to fold a sheet, wherein one folding roller among the pair of folding rollers is a first roller and another folding roller among the pair of folding rollers is a second roller;

a third roller that is in contact with the second roller;

a heating member located downstream of the pair of folding rollers in terms of a sheet conveyance direction; and a supporting unit that supports the heating member in a manner such that position of the heating member in terms of the sheet conveyance direction is changeable in accordance with an amount of conveyance imparted on the sheet by the pair of folding rollers after folding, wherein the position of the heating member in terms of the sheet conveyance direction changes such that the heating member is in contact with a leading edge of a fold portion of the sheet, the after-processing device further comprises a pressing member configured to perform an additional folding operation on the sheet by moving from a first position to a pressing position and pressing a portion of the sheet, which has been folded by the pair of folding rollers, into a region in which the second roller is in contact with the third roller, the portion of the sheet pressed by the pressing member differing from the fold portion, the supporting unit is supported by the pressing member in a manner such as to be moveable relative to the pressing member, and during movement of the pressing member towards the pressing position, movement of the supporting unit is restricted such that the heating member remains located downstream of the pair of folding rollers in terms of the sheet conveyance direction.

2. The after-processing device of claim 1, further comprising a movement suspending member configured to suspend rotation of the pair of folding rollers after folding of the sheet, wherein the supporting unit includes:

a supporting part that supports the heating member in a manner such as to be freely moveable in the sheet conveyance direction; and a biasing part that applies a force against the heating member in an opposite direction to the sheet conveyance direction, and the force is of a magnitude that, while the leading edge of the sheet is in contact with the heating member, allows unified movement of the heating member and the sheet in the sheet conveyance direction until conveyance of the sheet is suspended through suspension of rotation of the pair of folding rollers.

3. The after-processing device of claim 2, wherein the supporting unit further includes a switching part that causes switching of the heating member between a heating position located along a sheet conveyance path and a standby position separated from the sheet conveyance path, by moving the supporting part of the supporting unit.

4. The after-processing device of claim 3 wherein the after-processing device further comprises:

a movement direction of the supporting part of the supporting unit is parallel to a pressing direction of the pressing member.

5. The after-processing device of claim 4, wherein the supporting part is supported by the pressing member in a manner such as to be freely moveable in the pressing direction, and the supporting unit further includes:

a supporting part biaser that applies a force on the supporting part in the same direction as the pressing direction; and a position determining part that when the supporting part moves toward a second position due to pressing operation of the pressing member, determines position of the heating member in a sheet thickness direction by engaging with the supporting part and halting movement of the supporting part against the force applied by the supporting part biaser.

6. The after-processing device of claim 5, wherein the position determining part is a rotational axle of the second roller.

7. The after-processing device of claim 4, wherein the pressing member is located downstream of the heating member in terms of the sheet conveyance direction.

8. The after-processing device of claim 4, wherein a leading edge at an end of the pressing member that contacts with the sheet is located closer than the heating member to the region in which the second roller is in contact with the third roller.

9. The after-processing device of claim 1, further comprising a movement suspending member configured to suspend rotation of the pair of folding rollers after folding of the sheet, wherein when conveyance of the sheet is suspended through suspension of rotation of the pair of folding rollers after folding, the supporting unit moves the heating member, which is located downstream of the sheet in terms of the conveyance direction, in an opposite direction to the conveyance direction, and suspends movement of the heating member once the heating member is in contact with the leading edge of the fold portion of the sheet, and once heating by the heating member is complete, the supporting unit moves the heating member back to an original position thereof.

10. The after-processing device of claim 1, further comprising a stapler, wherein the sheet is provided in plurality as a sheet bundle, the stapler binds the sheet bundle, prior to folding of the sheet bundle by the pair of folding rollers, by inserting a staple at a target folding position of the sheet bundle, the heating member includes a heater and a magnet, the staple is formed from a material which is attracted by magnetic force of the magnet, the heater heats the leading edge of the fold portion of the sheet bundle, and the magnet of the heating member is located at a position corresponding in terms of a sheet width direction to a position at which the sheet bundle is bound by the stapler.

11. The after-processing device of claim 10, wherein a first surface which is an upstream surface of the heater in terms of the sheet conveyance direction and a second surface which is an upstream surface of the magnet in terms of the sheet conveyance direction have a stepped configuration such that the second surface is located downstream of the first surface in terms of the sheet conveyance direction, and when the leading edge of the fold portion of the sheet bundle is in contact with the first surface of the heater, the staple which protrudes out from the leading edge fits into a space formed by the stepped configuration.

12. An image formation apparatus comprising:

an image formation device configured to form an image on a sheet; and an after-processing device configured to perform after-processing on the sheet on which the image has been formed, wherein the after-processing device includes:

a pair of folding rollers configured to fold the sheet, wherein one folding roller among the pair of folding rollers is a first roller and another folding roller among the pair of folding rollers is a second roller;

a third roller that is in contact with the second roller;

a heating member located downstream of the pair of folding rollers in terms of a sheet conveyance direction; and a supporting unit that supports the heating member in a manner such that position of the heating member in terms of the sheet conveyance direction is changeable in accordance with an amount of conveyance imparted on the sheet by the pair of folding rollers after folding, wherein the position of the heating member in terms of the sheet conveyance direction changes such that the heating member is in contact with a leading edge of a fold portion of the sheet;

the after-processing device further includes a pressing member configured to perform an additional folding operation on the sheet by moving from a first position to a pressing position and pressing a portion of the sheet, which has been folded by the pair of folding rollers, into a region in which the second roller is in contact with the third roller, the portion of the sheet pressed by the pressing member differing from the fold portion;

the supporting unit is supported by the pressing member in a manner such as to be moveable relative to the pressing member;

during movement of the pressing member towards the pressing position, movement of the supporting unit is restricted such that the heating member remains located downstream of the pair of folding rollers in terms of the sheet conveyance direction.

13. The image formation apparatus of claim 12, wherein the after-processing device further includes a movement suspending member configured to suspend rotation of the pair of folding rollers after folding of the sheet, the supporting unit includes:

a supporting part that supports the heating member in a manner such as to be freely moveable in the sheet conveyance direction; and a biasing part that applies a force against the heating member in an opposite direction to the sheet conveyance direction, and the force is of a magnitude that, while the leading edge of the sheet is in contact with the heating member, allows unified movement of the heating member and the sheet in the sheet conveyance direction until conveyance of the sheet is suspended through suspension of rotation of the pair of folding rollers.

14. The image formation apparatus of claim 12, wherein
the after-processing device further includes a stapler,
the sheet is provided in plurality as a sheet bundle,
the stapler binds the sheet bundle, prior to folding of the sheet bundle by the pair of folding rollers, by inserting a staple at a target folding position of the sheet bundle,
the heating member includes a heater and a magnet,
the staple is formed from a material which is attracted by magnetic force of the magnet,
the heater heats the leading edge of the fold portion of the sheet bundle, and
the magnet of the heating member is located at a position corresponding in terms of a sheet width direction to a position at which the sheet bundle is bound by the stapler.

* * * * *